US009171654B2

(12) United States Patent
Hinrichs et al.

(10) Patent No.: US 9,171,654 B2
(45) Date of Patent: Oct. 27, 2015

(54) HIGH THERMAL STABILITY PELLET COMPOSITIONS FOR THERMAL CUTOFF DEVICES AND METHODS FOR MAKING AND USE THEREOF

(71) Applicant: Therm-O-Disc, Incorporated, Mansfield, OH (US)

(72) Inventors: Katherine Hinrichs, Shelby, OH (US); Changcai Zhao, Shenzhen (CN)

(73) Assignee: Therm-O-Disc, Incorporated, Mansfield, OH (US)

( * ) Notice: Subject to any disclaimer, the term of this patent is extended or adjusted under 35 U.S.C. 154(b) by 141 days.

(21) Appl. No.: 13/918,548

(22) Filed: Jun. 14, 2013

(65) Prior Publication Data

US 2013/0334471 A1 Dec. 19, 2013

(51) Int. Cl.
*H01B 1/12* (2006.01)
*H01H 37/76* (2006.01)

(52) U.S. Cl.
CPC ..... *H01B 1/12* (2013.01); *H01H 37/764* (2013.01); *H01H 37/76* (2013.01); *H01H 2037/769* (2013.01)

(58) Field of Classification Search
CPC ..... H01B 1/12; H01H 37/76; H01H 85/86
USPC ..... 252/62.3 Q, 519.3, 500; 361/93.8, 91.2, 361/91.1, 103
See application file for complete search history.

(56) References Cited

U.S. PATENT DOCUMENTS

| | | | |
|---|---|---|---|
| 3,281,559 | A | 10/1966 | Ebensteiner |
| 3,519,972 | A | 7/1970 | Merrill |
| 3,571,777 | A | 3/1971 | Tully |
| 3,692,921 | A | 9/1972 | Yonkers |
| 3,711,428 | A | 1/1973 | Aycock et al. |
| 3,727,164 | A | 4/1973 | Cartier et al. |
| 3,745,507 | A | 7/1973 | Ishida et al. |
| 3,781,737 | A | 12/1973 | Henry |
| 3,793,716 | A | 2/1974 | Smith-Johannsen |
| 3,883,837 | A | 5/1975 | Wolfe et al. |
| 3,898,602 | A | 8/1975 | Schurter |
| 3,924,218 | A | 12/1975 | Plasko |
| 3,930,215 | A | 12/1975 | Senor |
| 3,951,582 | A | 4/1976 | Holub et al. |
| 3,974,105 | A | 8/1976 | Sato et al. |
| 4,001,754 | A | 1/1977 | Plasko |
| 4,006,443 | A | 2/1977 | Kouchich et al. |
| 4,023,072 | A | 5/1977 | Plasko |
| 4,031,497 | A | 6/1977 | Ozawa |
| 4,065,741 | A | 12/1977 | Sakamoto et al. |
| 4,068,204 | A | 1/1978 | Iwanari et al. |
| 4,075,595 | A | 2/1978 | Plasko |
| 4,075,596 | A | 2/1978 | Plasko |
| 4,084,147 | A | 4/1978 | Mlyniec et al. |
| 4,142,418 | A | 3/1979 | Lagher |
| 4,184,139 | A | 1/1980 | Hara |
| 4,186,366 | A | 1/1980 | McVey |
| 4,189,697 | A | 2/1980 | Hara |
| 4,197,634 | A | 4/1980 | Plasko |
| 4,249,154 | A | 2/1981 | Grable |
| 4,259,656 | A | 3/1981 | Smith |
| 4,276,531 | A | 6/1981 | Davis |
| 4,276,532 | A | 6/1981 | Aoki |
| 4,281,308 | A | 7/1981 | McVey |
| 4,281,309 | A | 7/1981 | Olson |
| 4,310,469 | A | 1/1982 | Crivello |
| 4,322,705 | A | 3/1982 | Hara |
| 4,344,061 | A | 8/1982 | Niwa |
| 4,373,556 | A | 2/1983 | Bergh |
| 4,384,267 | A | 5/1983 | Aoki |

(Continued)

FOREIGN PATENT DOCUMENTS

| | | | |
|---|---|---|---|
| CN | 2385431 | Y | 6/2000 |
| CN | 101685733 | A | 3/2010 |

(Continued)

OTHER PUBLICATIONS

First Office Action issued by the Patent Office of the People's Republic of China on May 7, 2013 for Chinese Patent Application No. 200910211606.9 (Pub. No. CN 101685733), translation provided by Liu, Shen & Associates.
Extended European Search Report issued by the European Patent Office on Sep. 24, 2013 for European Patent Application No. 13172335.5 (not yet published).
International Standard, IEC 60691, Third Ed. (Dec. 2002).
Wacker Silicones, HDK® N20, Pyrogenic Silica—Fumed Silica, Version 3.3, 2 pages (Apr. 15, 2005).
Dow Corning® Si Powder Resin Modifiers, Product Information, Plastics, Form No. 22-1745B-01, 4 pages (Oct. 19, 2011).
Wacker Silicones, HDK®—Pyrogenic Silica, 6180e, 12 pages (May 2010).
Wacker Silicones, Perfect Toners Hide a Secret: HDK®—Pyrogenic Silica, 6178e, 22 pages (Sep. 2007).

(Continued)

*Primary Examiner* — Douglas McGinty
(74) *Attorney, Agent, or Firm* — Harness, Dickey & Pierce, P.L.C.

(57) ABSTRACT

The present disclosure provides a pellet composition having enhanced thermal stability for use in a thermally-actuated, current cutoff device. Certain inorganic stability additive particles, such as silica, talc, and siloxane, can be mixed with one or more organic compounds to form a thermal pellet composition. A solid thermal pellet maintains its structural rigidity up to a transition temperature ($T_f$), but further has improved overshoot temperature ranges. Therefore, the improved thermal pellets have a maximum dielectric capability temperature ($T_{cap}$), above which the pellet composition may lose substantial dielectric properties and conducts current that is at least 50° C. greater than the $T_f$. In certain variations, maximum dielectric capability temperature ($T_{cap}$) is greater than or equal to about 380° C.

29 Claims, 6 Drawing Sheets

(56) References Cited

U.S. PATENT DOCUMENTS

| | | | | |
|---|---|---|---|---|
| 4,480,247 | A | 10/1984 | Hara | |
| 4,514,718 | A | 4/1985 | Birx | |
| 4,529,957 | A | 7/1985 | Hara | |
| 4,630,023 | A | 12/1986 | Gawron et al. | |
| 4,675,641 | A | 6/1987 | Hampton et al. | |
| 4,757,423 | A | 7/1988 | Franklin | |
| 4,763,099 | A | 8/1988 | Balderson | |
| 4,763,228 | A | 8/1988 | Su | |
| 4,786,438 | A | 11/1988 | Blackmore | |
| 4,808,965 | A | 2/1989 | Cenky | |
| 4,821,010 | A | 4/1989 | Plasko | |
| 4,841,273 | A | 6/1989 | Horton | |
| 4,873,506 | A | 10/1989 | Gurevich | |
| 4,873,604 | A | 10/1989 | Goldberg et al. | |
| 4,878,038 | A | 10/1989 | Tsai | |
| 4,881,055 | A | 11/1989 | Capp et al. | |
| 4,933,658 | A | 6/1990 | Gerhardt et al. | |
| 4,968,962 | A | 11/1990 | Hohider et al. | |
| 5,003,283 | A | 3/1991 | Cenky | |
| 5,015,514 | A | 5/1991 | Rinehart | |
| 5,017,545 | A | 5/1991 | Kanda et al. | |
| 5,027,101 | A | 6/1991 | Morrill, Jr. | |
| 5,106,538 | A | 4/1992 | Barma et al. | |
| 5,106,540 | A | 4/1992 | Barma et al. | |
| 5,153,553 | A | 10/1992 | Ruehl et al. | |
| 5,171,774 | A | 12/1992 | Ueno et al. | |
| 5,173,593 | A | 12/1992 | Ogino et al. | |
| 5,212,261 | A | 5/1993 | Stierman | |
| 5,473,303 | A | 12/1995 | Hohider | |
| 5,530,417 | A | 6/1996 | Hohider | |
| 5,545,679 | A | 8/1996 | Bollinger, Jr. et al. | |
| 5,601,924 | A | 2/1997 | Beane et al. | |
| 5,663,702 | A | 9/1997 | Shaw, Jr. et al. | |
| 5,712,610 | A | 1/1998 | Takeichi et al. | |
| 5,750,277 | A | 5/1998 | Vu et al. | |
| 5,772,949 | A | 6/1998 | Haider et al. | |
| 5,777,540 | A | 7/1998 | Dedert et al. | |
| 5,808,538 | A | 9/1998 | Nguyen | |
| 5,816,493 | A | 10/1998 | Pirkle | |
| 5,825,277 | A | 10/1998 | Bishop et al. | |
| 5,837,164 | A | 11/1998 | Zhao | |
| 5,856,773 | A | 1/1999 | Chandler et al. | |
| 5,914,649 | A | 6/1999 | Isono et al. | |
| 5,929,741 | A | 7/1999 | Nishimura et al. | |
| 5,939,968 | A | 8/1999 | Nguyen et al. | |
| 5,963,121 | A | 10/1999 | Stygar et al. | |
| 5,985,182 | A | 11/1999 | Zhao | |
| 5,993,698 | A | 11/1999 | Frentzel et al. | |
| 6,059,997 | A | 5/2000 | Hall | |
| 6,133,547 | A | 10/2000 | Maynard | |
| 6,150,051 | A | 11/2000 | Du Pasquier et al. | |
| 6,157,528 | A | 12/2000 | Anthony | |
| 6,188,559 | B1 * | 2/2001 | Vincent et al. | 361/117 |
| 6,215,636 | B1 | 4/2001 | Hellemans | |
| 6,274,852 | B1 | 8/2001 | Blok et al. | |
| 6,282,074 | B1 | 8/2001 | Anthony | |
| 6,300,859 | B1 | 10/2001 | Myong et al. | |
| 6,359,544 | B1 | 3/2002 | Blok | |
| 6,375,867 | B1 | 4/2002 | Smith et al. | |
| 6,388,553 | B1 | 5/2002 | She et al. | |
| 6,388,856 | B1 | 5/2002 | Anthony | |
| 6,396,384 | B1 | 5/2002 | Blok et al. | |
| 6,403,935 | B2 | 6/2002 | Kochman et al. | |
| 6,452,138 | B1 | 9/2002 | Kochma et al. | |
| 6,489,879 | B1 | 12/2002 | Singh et al. | |
| 6,515,570 | B2 | 2/2003 | Kaltenborn et al. | |
| 6,563,094 | B2 | 5/2003 | Kochman et al. | |
| 6,673,257 | B1 * | 1/2004 | Hudson | 252/62.3 Q |
| 6,713,733 | B2 | 3/2004 | Kochman et al. | |
| 6,806,806 | B2 | 10/2004 | Anthony | |
| 6,812,276 | B2 | 11/2004 | Yeager | |
| 6,878,782 | B2 | 4/2005 | Merfeld et al. | |
| 6,922,131 | B2 | 7/2005 | Walsh et al. | |
| 6,981,319 | B2 | 1/2006 | Shrier | |
| 7,154,369 | B2 | 12/2006 | Dietz et al. | |
| 7,205,035 | B2 | 4/2007 | Merfeld | |
| 7,235,192 | B2 | 6/2007 | Yeager et al. | |
| 7,250,477 | B2 | 7/2007 | Guo et al. | |
| 7,323,966 | B2 | 1/2008 | Yoshikawa | |
| 7,330,098 | B2 | 2/2008 | Yoshikawa | |
| 7,362,208 | B2 | 4/2008 | Yoshikawa et al. | |
| 7,439,844 | B2 | 10/2008 | Hase et al. | |
| 7,532,101 | B2 | 5/2009 | Suzuki | |
| 7,785,732 | B2 | 8/2010 | Chang et al. | |
| 2002/0196592 | A1 | 12/2002 | Chen et al. | |
| 2003/0112117 | A1 | 6/2003 | Miyashita et al. | |
| 2004/0191556 | A1 | 9/2004 | Jardine | |
| 2005/0088272 | A1 | 4/2005 | Yoshikawa | |
| 2005/0179516 | A1 | 8/2005 | Yoshikawa | |
| 2006/0204202 | A1 | 9/2006 | Hanemann et al. | |
| 2006/0208845 | A1 | 9/2006 | Yoshikawa | |
| 2006/0232372 | A1 | 10/2006 | Yoshikawa | |
| 2008/0006795 | A1 * | 1/2008 | Khatua et al. | 252/500 |
| 2010/0033295 | A1 * | 2/2010 | Kent et al. | 337/405 |
| 2012/0121795 | A1 | 5/2012 | Kent et al. | |

FOREIGN PATENT DOCUMENTS

| | | | |
|---|---|---|---|
| DE | 186526 | | 2/1904 |
| DE | 3422528 | | 12/1985 |
| EP | 1528586 | | 4/2005 |
| EP | 2151846 | | 2/2010 |
| EP | 2674956 | A1 | 12/2013 |
| GB | 1255589 | | 12/1971 |
| JP | 10-177833 | | 6/1998 |
| JP | 2002163966 | | 6/2002 |
| KR | 20020021065 | | 3/2002 |
| TW | 552604 | | 9/2003 |
| WO | WO 00/19773 | | 4/2000 |
| WO | WO 02/069671 | | 9/2002 |
| WO | WO 2004/109868 | | 12/2004 |

OTHER PUBLICATIONS

Parker, Earl E., Modern Plastics, 36(10), pp. 135-136, 138, 208 (1959) (Abstract Only).

Aldrich Catalog, pp. 42, 114, 606, 1181 (1996).

Communication issued by the European Patent Office on Mar. 22, 2012 enclosing the Partial European Search Report dated Mar. 16, 2012 for European Patent Application No. 09167298.0.

Communication issued by the European Patent Office on Jun. 19, 2012 enclosing the Extended European Search Report dated Jun. 12, 2012 for European Patent Application No. 09167298.0.

Communication issued by the European Patent Office on Jul. 23, 2012 for European Patent Application No. 09167298.0.

Response to Communication issued by the European Patent Office on Jul. 23, 2012 for European Patent Application No. 09167298.0 as filed on Jan. 18, 2013.

Communication issued by the European Patent Office on Mar. 7, 2013 for European Patent Application No. 09167298.0.

The Merck Index Online, https://www.rsc.org/Merck-Index/monograph/mono1500009925/triptycene?q=authorize (retrieved on Mar. 24, 2014).

Second Office Action issued by the Patent Office of the People's Republic of China on Feb. 8, 2014 for Chinese Patent Application No. 200910211606.9 (Pub. No. CN 101685733), translation provided by Liu, Shen & Associates.

Decision of Final Rejection of the Application issued by the Patent Office of the People's Republic of China on May 27, 2014 for Chinese Patent Application No. 200910211606.9 (Pub. No. CN 101685733).

Response to Extended European Search Report issued by the European Patent Office on Sep. 24, 2013 for European Patent Application No. 13172335.5 (Pub. No. EP 2674956), as filed on Jun. 18, 2014.

* cited by examiner

HIGH THERMAL STABILITY PELLET COMPOSITIONS FOR THERMAL CUTOFF DEVICES AND METHODS FOR MAKING AND USE THEREOF

CROSS-REFERENCE TO RELATED APPLICATIONS

This application claims the benefit and priority of Chinese Patent Application No. 201210201999.7, filed Jun. 15, 2012. The entire disclosure of the above application is incorporated herein by reference.

FIELD

The present disclosure relates to material compositions for electrical current interruption devices and more particularly to improved pellet compositions and materials for thermally stable electrical current interruption safety devices, or thermal cut-offs, that include performance enhancing inorganic additives for improved thermal performance.

BACKGROUND

This section provides background information related to the present disclosure which is not necessarily prior art.

Temperatures of operation for appliances, electronics, motors and other electrical devices typically have an optimum range. The temperature range where damage can occur to system components or where the device becomes a potential safety hazard in the application or to the end-user serves as an important detection threshold. Various devices are capable of sensing such over-temperature thresholds. Certain devices which are capable of sensing over-temperature conditions and interrupting electrical current include electrical thermal fuses, which only operate in a narrow temperature range. For example, tin and lead alloys, indium and tin alloys, or other metal alloys which form a eutectic metal, are unsuitable for appliance, electronic, electrical and motor applications due to undesirably broad temperature response thresholds and/or detection temperatures that are outside the desired range of safety.

One type of device particularly suitable for over-temperature detection is an electrical current interruption safety device, known as a thermal cut-off (TCO), which is capable of temperature detection and simultaneous interruption of current, when necessary. Such TCO devices are typically installed in an electrical application between the current source and electrical components, such that the TCO is capable of interrupting the circuit continuity in the event of a potentially harmful or dangerous over-temperature condition. TCOs are often designed to shut off the flow of electric current to the application in an irreversible manner, without the option of resetting the TCO current interrupting device. Certain appliances and applications require the use of robust over-temperature detection devices with high-holding temperatures exceeding the operating temperatures and/or holding temperatures of conventional TCO designs. Thus, in various aspects, the present disclosure provides TCO designs that are thermally stable and continue to exhibit dielectric properties after activation or current interruption, even at high temperatures.

SUMMARY

This section provides a general summary of the disclosure, and is not a comprehensive disclosure of its full scope or all of its features.

In certain aspects, the present disclosure provides a pellet composition for use in a thermally-actuated, current cutoff device. The pellet composition comprises one or more organic compounds, as well as one or more inorganic stability additive particles selected from the group consisting of: silica, talc, siloxane, and combinations thereof. In certain variations, one or more organic compounds are present at greater than or equal to about 93% by weight of the total pellet composition. Further, one or more inorganic stability additive particles are optionally present at less than or equal to about 5% by weight of the total pellet composition. Such a pellet composition is in a solid phase and maintains its structural rigidity up to a transition temperature ($T_f$). The pellet composition also has a maximum dielectric capability temperature ($T_{cap}$), above which the pellet composition may lose substantial dielectric properties. In accordance with certain aspects of the present disclosure, $T_{cap}$ is at least about 50° C. greater than the $T_f$ for the inventive pellet compositions.

In other aspects, a pellet composition is provided by the present teachings for use in a thermally-actuated, current cutoff device that comprises one or more organic compounds and one or more inorganic stability additive particles present at less than about 3% by weight of the total pellet composition. The one or more organic compounds are selected from the group of consisting of: m-phenylenedibenzoate, dimethyl terephthalate, p-acetotoluidide, benzanilide, 2',6',acetoxylidide, dimethylacetanilide, 7-hydroxy-4-methylcoumarin, coumarin, benzoguanimine, and combinations thereof. The one or more inorganic stability additive particles are selected from the group consisting of: silica, talc, siloxane, and combinations thereof. The pellet composition is in a solid phase and maintains its structural rigidity up to a transition temperature ($T_f$). However, the pellet composition also has a maximum dielectric capability temperature ($T_{cap}$) above which the pellet composition loses substantial dielectric properties and conducts current that is about 50° C. or greater than the $T_f$.

In other aspects, the present teachings provide methods for enhancing thermal stability of a pellet composition for use in a thermally-actuated, current cutoff device. Such a method comprises introducing one or more inorganic stability additive particles selected from the group consisting of: silica, talc, siloxane, and combinations thereof to an initial pellet composition. The initial pellet composition maintains its structural rigidity up to a transition temperature ($T_f$) and has an initial maximum dielectric capability temperature ($T_{capinitial}$) above which the initial pellet composition may lose substantial dielectric properties and conducts current. In various aspects, the initial maximum dielectric capability temperature ($T_{capinitial}$) is greater than the transition temperature $T_f$. In certain variations, the initial maximum dielectric capability temperature ($T_{capinitial}$) falls within a range that is 100° C. or less above $T_f$ (so that $T_f < T_{capinitial} \leq (T_f + 100°\ C.)$). After introducing of the one or more inorganic stability additive particles to the initial pellet composition, an improved pellet composition is formed that exhibits the same $T_f$ as the initial pellet composition, but has an improved maximum dielectric capability temperature ($T_{capimproved}$) that is about 50° C. or greater than the $T_f$, so that $T_{capimproved} \geq (T_f + 50°\ C.)$. In certain variations, the improved maximum dielectric capability temperature ($T_{capimproved}$) may be well in excess of 50° C. greater than the $T_f$ for example, at least about 100° C. or more above the $T_f$.

In yet other aspects, a method for enhancing thermal stability of a pellet composition for use in a thermally-actuated, current cutoff device. The method comprises introducing one or more inorganic stability additive particles selected from the group consisting of: silica, talc, siloxane, and combinations thereof to an initial pellet composition that maintains its structural rigidity up to a transition temperature ($T_f$). After the introducing of the one or more inorganic stability additive particles to the initial pellet composition, an improved pellet composition is formed that exhibits the same $T_f$ as the initial pellet composition, but has a slower rate of aging at a temperature below the $T_f$ of at least 2%, as compared to the initial pellet composition.

The present disclosure also provides methods for making a pellet composition having enhanced thermal stability for use in a thermally-actuated, current cutoff device. Such a method optionally comprises admixing one or more organic compounds and one or more inorganic stability additive particles selected from the group consisting of: silica, talc, siloxane, and combinations thereof. The mixture is then pelletized and compacted to form a solid thermal pellet that is capable of use in the thermally-actuated, current cutoff device. The solid thermal pellet thus formed maintains its structural rigidity up to a transition temperature ($T_f$). The pellet composition also has maximum dielectric capability temperature ($T_{cap}$), above which the pellet composition loses substantial dielectric properties. In certain variations, the pellet composition has a $T_{cap}$ of at least about 50° C. greater than the $T_f$. In certain variations, $T_{cap}$ is greater than or equal to about 380° C.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 8:
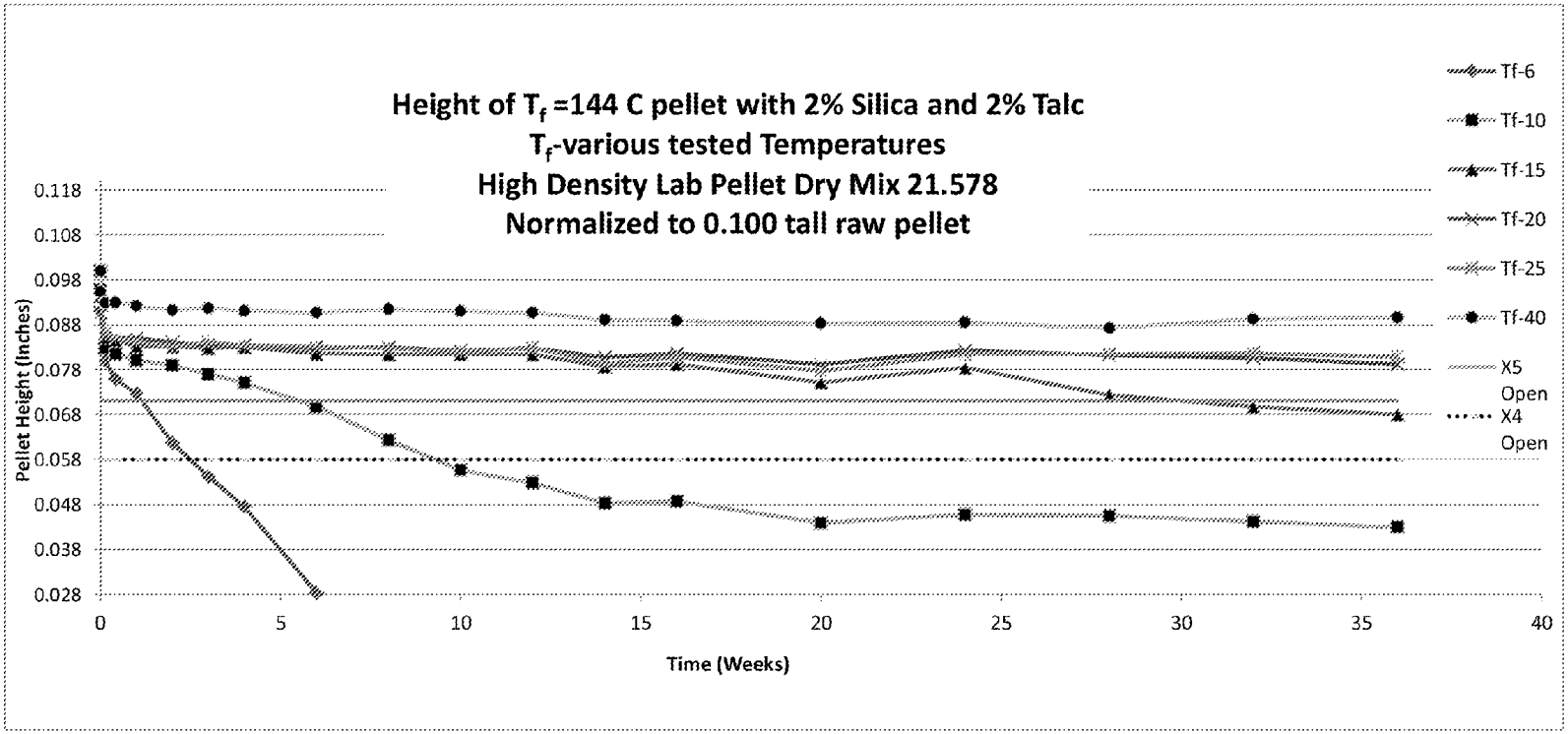
Figure 9:
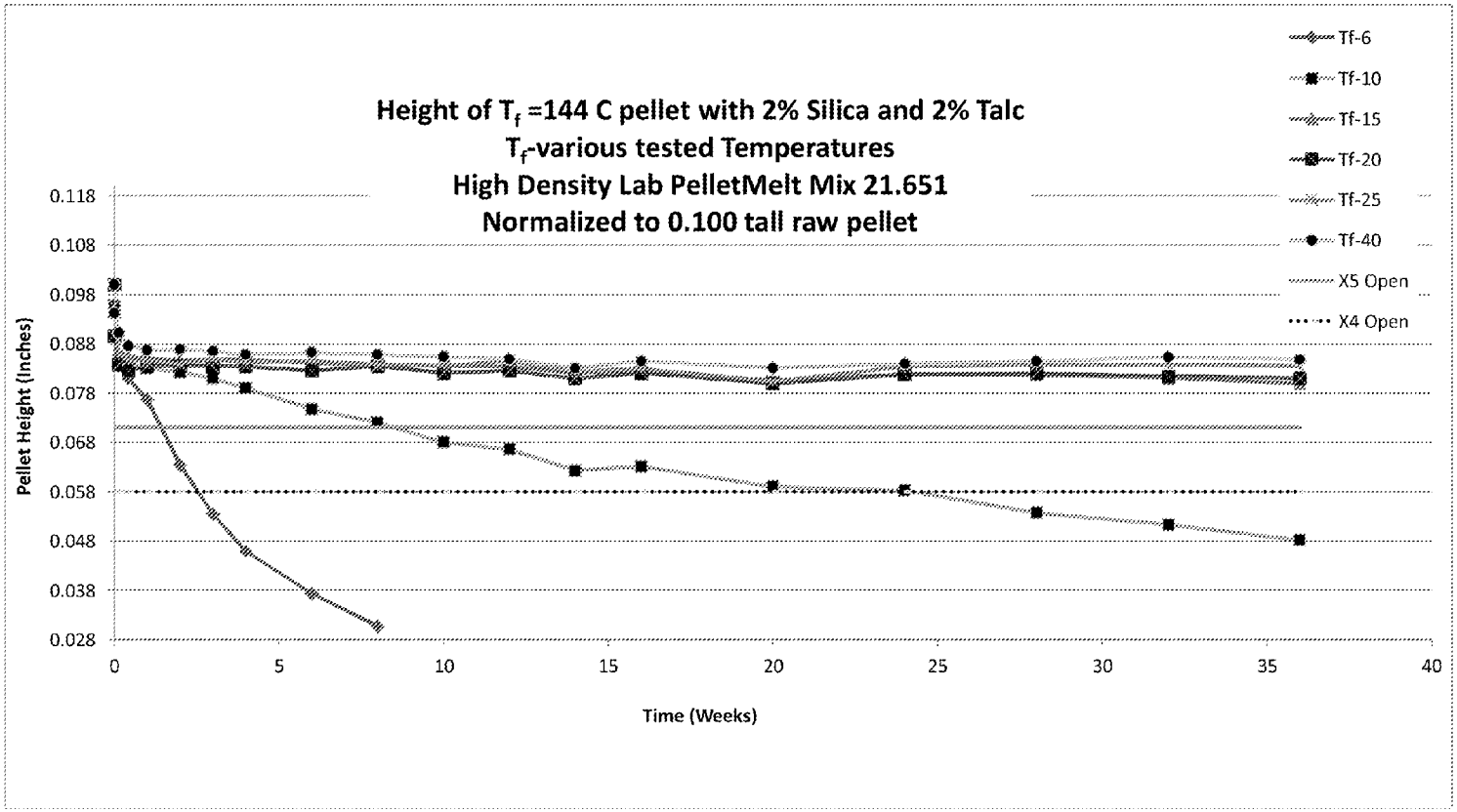

FIG. 8 is a graph showing pellet height over time for a pellet composition prepared in accordance with certain principles of the present disclosure in Example 3, comprising dimethyl terephthalate and inorganic stability additives (2% fumed silica and 2% talc), prepared as a high density lab pellet dry mixture; and FIG. 9 is a graph showing pellet height over time for another pellet composition prepared in accordance with certain principles of the present disclosure in Example 3, comprising dimethyl terephthalate and inorganic stability additives (2% fumed silica and 2% talc), prepared as a high density lab pellet melt mix.

Corresponding reference numerals indicate corresponding parts throughout the several views of the drawings.

DETAILED DESCRIPTION

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Throughout this disclosure, the numerical values represent approximate measures or limits to ranges to encompass minor deviations from the given values and embodiments having about the value mentioned as well as those having exactly the value mentioned. Other than in the working examples provided at the end of the detailed description, all numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, disclosure of ranges includes disclosure of all values and further divided ranges within the entire range, including endpoints given for the ranges.

Example embodiments will now be described more fully with reference to the accompanying drawings. Various safety electrical current interruption devices, including thermal cut-off electrical current interruption safety devices ("TCOs") are used as safety devices in a broad range of application temperatures. The TCOs are incorporated into an electrical device, such an appliance, motor, or consumer device, and serve as a safety device by breaking or interrupting electrical current above a threshold temperature or temperature rating, typically ranging from about 60° C. up to about 235° C. Certain higher temperature applications may employ high temperature TCO (HTTCO) devices that break electrical current above temperatures greater than or equal to about 240° C., such as those taught in commonly assigned U.S. Publication No. 2010/0033295 to Kent et al., and incorporated herein by reference. In the accompanying discussion, the term "TCO" encompasses both conventional TCO devices and their high-temperature counterparts (HTTCOs). The present teachings pertain to improved pellet compositions for thermal cut-off devices having greater thermal stability and robustness, particularly at overshoot temperatures above which the materials actuate the TCO device.

Figure 1:
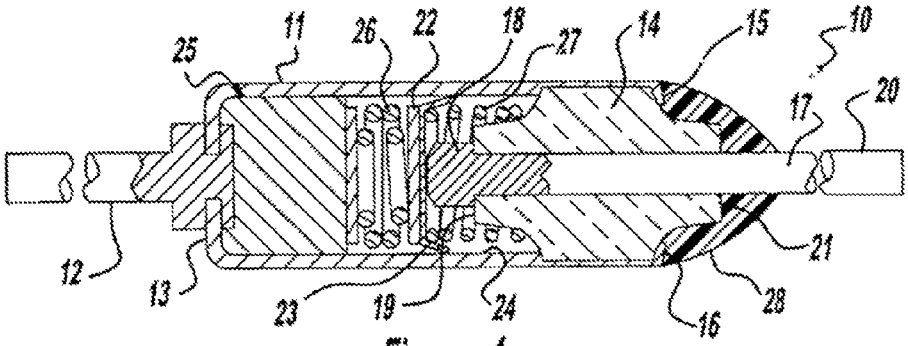
FIG. 1 is an enlarged cross sectional view of an exemplary conventional thermal cutoff device construction.
Figure 2:
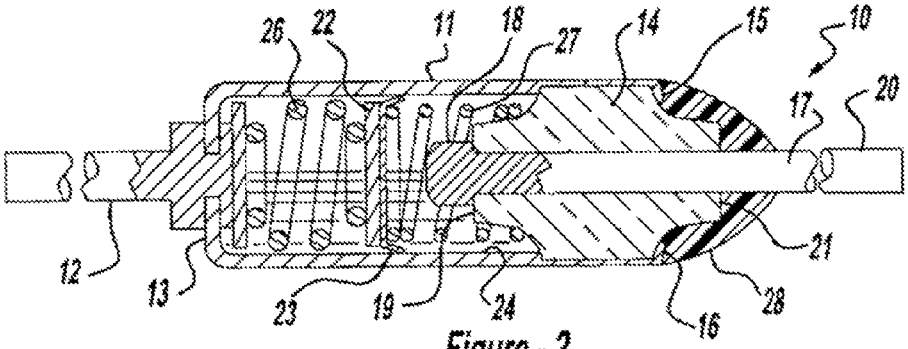
FIG. 2 illustrates the thermal cutoff device construction of FIG. 1 after a thermal pellet has undergone a physical transition and a current interruption actuating assembly has caused electrical switching to break continuity and change the thermal cutoff device's operating condition.

By way of background, an exemplary conventional TCO device is described herein, as set forth in FIGS. 1 and 2. In general, a conventional TCO 10 includes a conductive metallic housing or casing 11 having a first metallic electrical conductor 12 in electrical contact with a closed end 13 of the housing 11. An isolation bushing 14, such as a ceramic bushing, is disposed in an opening 15 of the housing 11. Housing 11 further includes a retainer edge 16, which secures the ceramic bushing 14 within the end of the housing 11. An electric current interrupter assembly for actuating the device in response to a high temperature, for example, by breaking continuity of an electrical circuit, includes an electric contact 17, such as a metallic electrical conductor, at least partially disposed within the housing 11 through opening 15. Electric contact 17 passes through isolation bushing 14 and has an enlarged terminal end 18 disposed against one side 19 of isolation bushing 14 and a second end 20 projecting out of the outer end 21 of isolation bushing 14.

A seal 28 is disposed over the opening 15 and can create sealing contact with the housing 11 and its retainer edge 16, the isolation bushing 14, and the exposed portion of the second end 20 of electric contact 17. In this manner, an interior portion 29 of the housing 11 is substantially sealed from the external environment 30. By "substantially sealed" it is meant that while the barrier seal is optionally porous at a microscopic level, the barrier is capable of preventing escape or significant mass loss of the thermal pellet material, for example, the seal retains at least about 98-99% of the mass of the initial thermal pellet through 1,000 hours of continuous operation at a predetermined temperature within the housing, in certain variations.

Figure 4:
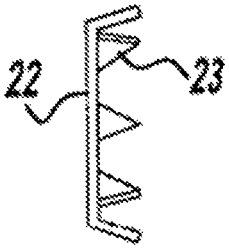
FIG. 4 is a side view of a sliding contact member of the current interruption actuating assembly switch construction of FIG. 1.

The current interruption assembly, which actuates or switches to change continuity of an electrical circuit, further includes a sliding contact member 22, formed of electrically conductive material, such as a metal is disposed inside the housing 11 and has resilient peripheral fingers 23 (FIG. 4) disposed in sliding engagement with the internal peripheral surface 24 of the housing 11 to provide electrical contact there between. Moreover, when the TCO has an operating temperature that is below the predetermined threshold or set-point temperature of the TCO device, the sliding contact member 22 is disposed in electrical contact with the terminal end 18 of electric contact 17.

Current interruption assembly also includes a compression mechanism, which may include a plurality of distinct compression mechanisms. The compression mechanism biases the sliding contact member 22 against the terminal end 18 of electric contact 17 to establish electrical contact in the first operating condition (where operating temperatures are below the threshold temperature of the TCO device, as will be described below). As shown in FIGS. 1 and 2, the compression mechanism includes a pair of springs, which are respectively disposed on opposite sides of the sliding contact member 22. The springs include a relatively strong compression spring 26 and a relatively weak compression trip spring 27.

Figure 3:
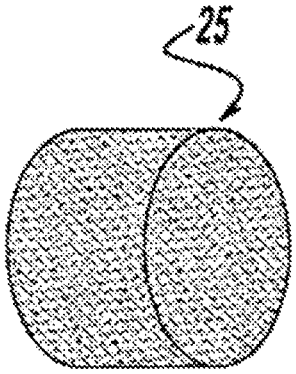
FIG. 3 is a side perspective view illustrating a thermally stable pellet according to certain aspects of the present disclosure.

A thermally responsive pellet or thermal pellet 25, as best illustrated in FIG. 3, is disposed in the housing 11 against the end wall 13 thereof. The compression spring 26 is in a compressed state between the solid thermal pellet 25 and the sliding contact member 22 and in the exemplary design shown, generally has a stronger compressed force than the force of the compressed trip spring 27, which is disposed between the contact member 22 and the isolation bushing 14, such that the sliding contact member 22 is biased towards (e.g., held by the force of the spring 26) and in electrical contact with the enlarged end 18 of the electrical contact 17. In this manner, an electrical circuit is established between the first electrical conductor 12 and electrical contact 17 through the conductive housing 11 and sliding contact member 22.

As noted above, the TCO device is designed to include a thermal pellet 25 that comprises a pellet composition in a solid phase that is reliably stable in the first operating condition (where the operating temperature, for example, the temperature of the surrounding environment 30, is below a threshold temperature); however reliably transitions to a different physical state when the operating temperature meets or exceeds such a threshold temperature in a second operating condition. Thus, the pellet composition that forms thermal pellet 25 is in a solid phase and maintains its structural rigidity up to a threshold or final temperature ($T_f$) (also referred to as a transition, actuation, or threshold temperature), at which point internal contact breaks continuity due to structural changes in the pellet material composition, which in turn causes relaxing or opening of compression mechanisms, for example. When the operating temperature meets or exceeds the transition temperature $T_f$, the thermal pellet 25 melts, liquefies, softens, volatilizes, sublimates, or otherwise transitions to a different physical state to transform from a solid having structural rigidity to a form or phase that loses structural rigidity, either by contraction, displacement, or other physical changes, during an adverse heating condition, which is illustrated in FIG. 2. When the surrounding environment reaches the transition or final temperature ($T_f$), and the pellet loses structural rigidity, it causes the internal electrical contacts to separate due to the applied force from the expanding trip spring 27. In certain alternative device configurations, the device may remain electrically closed after activation as appreciated by those of skill in the art and such variations are likewise contemplated by the present teachings. However, after a pellet composition reaches and then exceeds the transition temperature ($T_f$) and breaks electrical continuity, to serve as an efficacious safety device, the material composition should be thermally stable and continue to exhibit dielectric properties for temperature ranges well in excess of the transition temperature ($T_f$). This is sometimes referred to as a thermal overshoot temperature range. Thus, a thermal pellet composition also has a maximum dielectric capability temperature ($T_{cap}$), above which the pellet can lose its dielectric and/or insulation resistance properties and/or begins to conduct electrical current in a typical TCO device. The $T_{cap}$ is related to a maximum temperature rating ($T_{max}$) of the thermal pellet composition. A $T_{max}$ is a rated temperature at which 100% of the TCO devices tested (incorporating the pellet composition) will continue to remain electrically opened after activation, actuation, or tripping to continue to provide safety benefits in the device (in a temperature range above the $T_f$) at specified test conditions discussed below. The $T_{max}$ is typically selected to be below the $T_{cap}$ as a margin of safety for use in a given application.

Figure 5:
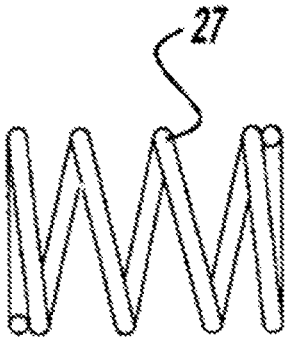
FIG. 5 is a side view of one of the springs of the current interruption actuating assembly of FIG. 1.

The springs 26 and 27 thus are adapted to expand and relax, as illustrated by expanded trip spring 27 in FIG. 5, and through the relationship of the particular forces and length of the compression spring 26 and compression trip spring 27, the sliding contact member 22 is moved out of electrical contact with the end 18 of the electric contact 17 in the manner shown in FIG. 2, so that the electrical circuit between the terminal conductor 12 and electrical contact 17 through the thermal cutoff construction 10 (via the housing 11 and sliding contact member 22) is discontinued and broken, remaining open as illustrated in FIG. 2. The thermal cutoff device described in the present disclosure is used for purposes of illustration is exemplary and therefore should not be construed to necessarily be limiting. In certain aspects, various components, designs, or operating principles may be varied in number or design. Various other thermal switching or cutoff devices are known in the art and likewise contemplated by the present disclosure.

As described above, in various aspects, pellet material compositions are designed to have a transition temperature that permits the TCO device to have a final temperature ($T_f$) (also referred to as transition, actuation, or threshold temperature), where activation within the device can break internal contacts due to structural changes in the pellet material composition. Thus, the pellet composition is in a solid phase and maintains its structural rigidity up to a transition or final temperature ($T_f$), at which point, a switch in continuity is activated due to structural transitioning or breakdown of the solid thermal pellet. Once the pellet material composition reaches its transition temperature ($T_f$), it means that the material no longer possesses the structural integrity required to maintain a compression mechanism, such as a switch in a held-closed position, depending on the TCO device, for example. This transition temperature ($T_f$) can also be referred to as a "melting-point" and provides the TCO device rating; however, the compounds in the pellet composition need not fully melt in a conventional sense to achieve separation of the electrical contacts to break the internal circuit and electrical continuity.

Various pellet chemicals can degrade at higher temperatures and can transition from having desirably high dielectric and insulating properties to being partially or fully electrically conductive. Thus, if the thermal pellet melts or physically softens after reaching and exceeding the transition temperature ($T_f$), but the temperature of the surrounding environment continues to rise to a point that the thermal pellet composition becomes electrically conductive, it is possible for the thermal pellet composition to re-establish electrical conductivity in the TCO safety device, and cause undesired overheating or hazardous conditions, and thus poses a potential safety concern.

Thus, $T_{cap}$ is generally understood to be a maximum overshoot temperature range above the transition temperature $T_f$ at which the TCO will remain electrically open. A maximum dielectric capability temperature ($T_{cap}$) is related to the $T_{max}$, but $T_{cap}$ may often significantly exceed the $T_{max}$ rated temperature. $T_{cap}$ is indicative of the pellet composition's high temperature stability, but as appreciated by those of skill in the art, may not correspond to rigorous industry-based testing standards for a $T_{max}$ rating exhibiting 100% passage of tested devices incorporating pellet compositions of interest. Further, while $T_{cap}$ may be assessed by the same test procedures and protocols as the $T_{max}$ rating tests, $T_{cap}$ may also be tested by alternative test procedures that are indicative of high temperature stability, for example, at differing voltage rates or temperatures than standard test conditions and protocols for $T_{max}$ rating like those described below. Usually, in the interest of safety, a margin of at least about 20° C.-30° C. is subtracted from $T_{cap}$ to arrive at a maximum temperature rating ($T_{max}$) to provide a rating for a given thermal pellet composition used in a TCO device. Thus, the $T_{cap}$ encompasses and in certain aspects, exceeds a rated $T_{max}$ for a given thermal pellet composition.

In various aspects, the pellet material compositions of the present teachings are thermally and chemically stable, reliable and robust for use in the thermal cutoff device application. Thus, after transitioning to the different physical state in the second operating condition, the pellet composition is exposed to operating temperatures in excess of threshold temperature in a third operating condition up to a maximum dielectric capability temperature ($T_{cap}$), up to which it is desirably stable and retains dielectric and insulative properties to prevent conduction of current therethrough. Hence, in certain aspects, the present teachings are directed to improving thermal stability and broadening overshoot temperatures (e.g., maximum dielectric capability temperature ($T_{cap}$) and/or a maximum temperature rating ($T_{max}$) ratings) for various thermal pellet compositions having a wide range of transition temperatures ($T_f$) for use in thermal cutoff devices.

In accordance with certain aspects of the present teachings, methods are provided for enhancing thermal stability of a pellet composition for use in a thermally-actuated, current cutoff device. Certain thermal pellet compositions in particular suffer from thermal instability at relatively low overshoot temperatures above $T_f$. For example, the present teachings are particularly suitable for use with pellet compositions having a maximum rated temperature $T_{max}$ and/or an initial maximum dielectric capability temperature ($T_{capinitial}$) (where the initial pellet composition may lose substantial dielectric properties and conducts current) at a temperature that is above the $T_f$, but falls within a range that is 100° C. or less above $T_f$ (so that $T_f<T_{capinitial}\leq(T_f+100°$ C.) and/or $T_f<T_{max}\leq(T_f+100°$ C.)). As noted above, a thermal pellet $T_{cap}$ typically encompasses and exceeds $T_{max}$. However, either $T_{max}$ or $T_{cap}$ can be employed to select pellet materials that would benefit from improved thermal stability provided by certain variations of the present teachings. Further, use of the terms $T_{capinitial}$ and $T_{capimproved}$ are used for nominative purposes and are used interchangeably with the generic term $T_{cap}$. Accordingly, those pellet material compositions that have an initial $T_{capinitial}$ (or a $T_{max}$) within a 100° C. of $T_f$ are generally understood to exhibit poor thermal stability and are particularly good candidates for improvement via the techniques provided by the present teachings.

In various aspects, the pellet compositions have an initial maximum dielectric capability temperature ($T_{capinitial}$) that exceeds the transition temperature $T_f$. In certain aspects, prior to treatment in accordance with the present teachings, the pellet compositions have an initial maximum dielectric capability temperature ($T_{capinitial}$) that exceeds the $T_f$ by less than or equal to about 90° C. above the $T_f$ (so that $T_f<T_{capinitial}\leq(T_f+90°$ C.); optionally less than or equal to about 80° C. (so that $T_f<T_{capinitial}\leq(T_f+80°$ C.); optionally less than or equal to about 70° C. (so that $T_f<T_{capinitial}\leq(T_f+70°$ C.); optionally less than or equal to about 60° C. (so that $T_f<T_{capinitial}\leq(T_f+60°$ C.); optionally less than or equal to about 50° C. (so that $T_f<T_{capinitial}\leq(T_f+50°$ C.); optionally less than or equal to about 40° C. (so that $T_f<T_{capinitial}\leq(T_f+40°$ C.); and in certain variations, optionally less than or equal to about 30° C. above the $T_f$ (so that $T_f<T_{capinitial}\leq(T_f+30°$ C.). In other aspects, the pellet compositions having relatively poor thermal stability prior to treatment may have an initial maximum rated temperature $T_{max}$ that exceeds the transition temperature $T_f$, but prior to treatment in accordance with the present teachings, the initial $T_{max}$ exceeds the $T_f$ by less than or equal to about 70° C. (so that $T_f<T_{max}\leq(T_f+70°$ C.); optionally less than or equal to about 60° C. (so that $T_f<T_{max}\leq(T_f+60°$ C.); optionally less than or equal to about 50° C. (so that $T_f<T_{max}\leq(T_f+50°$ C.); optionally less than or equal to about 40° C. (so that $T_f<T_{max}\leq(T_f+40°$ C.); and in certain variations, optionally less than or equal to about 30° C. in excess of the $T_f$ (so that $T_f<T_{max}\leq(T_f+30°$ C.).

In accordance with various principles of the inventive technology, it has been unexpectedly discovered that the introduction of at least one inorganic stability additive particle into such a relatively thermally unstable pellet composition significantly improves thermal stability, while $T_f$ of the solid thermal pellet remains substantially the same. In preferred aspects, such inorganic stability additive particles are selected from the group consisting of: silica, talc, siloxane, and combinations thereof. The presence of such inorganic stability additive particles in the thermal pellet composition significantly increases the maximum dielectric capability temperature ($T_{cap}$) for the thermal pellet composition, for example. A $T_{max}$ rating for the same thermal pellet composition may likewise be increased. In various aspects, a relatively small concentration of one or more inorganic stability additive particles present in the pellet composition provides the efficacious advantages like improving thermal stability, maximum dielectric capability temperature ($T_{cap}$), and in certain variations, may likewise provide an improved maximum temperature rating $T_{max}$.

Thus, in certain aspects, the methods of enhancing thermal stability of a pellet composition for use in a thermally-actuated, current cutoff device comprises introducing one or more inorganic stability additive particles selected from the group consisting of: silica, talc, siloxane, and combinations thereof to an initial pellet composition that maintains its structural rigidity up to a transition temperature ($T_f$) and has an initial maximum dielectric capability temperature ($T_{cap}$) above which the initial pellet composition may lose substantial dielectric properties and conducts current that is greater than the Tf, but falls within a range of about 100° C. from the $T_f$. After the one or more inorganic stability additive particles are introduced to the initial pellet composition, an improved pellet composition is thus formed that exhibits the same $T_f$ as the initial pellet composition, but has an improved maximum dielectric capability temperature ($T_{capimproved}$) that is about 50° C. or greater than the $T_f$. In certain variations, the improved maximum dielectric capability temperature ($T_{capimproved}$) is about 100° C. or greater than the $T_f$, as discussed in greater detail below.

In various aspects, the present disclosure provides a thermal pellet material composition that comprises one or more organic compounds that determine the thermal pellet material composition's transition temperature ($T_f$) up to which the pellet composition is in a solid phase and maintains its structural rigidity. Additionally, the thermal pellet material composition also comprises one or more inorganic additives that provide performance enhancement of a pellet composition. Particularly efficacious inorganic stability additive particles are selected from the group consisting of: silica, talc, siloxane, and combinations thereof. These inorganic stability additive particles unexpectedly improve the temperature stability of the thermal pellet material composition above, as well as improving temperature stability at temperatures below the transition temperature $T_f$. Such improved thermal stability above the transition temperature may be reflected by one or more of the following non-limiting benefits: (i) increasing a maximum dielectric capability temperature ($T_{cap}$), above which the pellet can lose its dielectric and/or insulation resistance properties and/or begins to conduct electrical current in a typical TCO device (as described further herein); (ii) increasing a maximum temperature ($T_{max}$) rating for a pellet composition; (iii) increasing breakdown voltages for the open TCO device at a predetermined temperature, as well as improving pellet stability below the transition temperature ($T_f$) (iv) slowing a rate of aging at temperatures near $T_f$ (e.g., at a test temperature within 10 or 15 degrees of $T_f$, $T_f-10°$ or $T_f-15°$).

In certain variations, such a stable thermal pellet material composition thus comprises one or more inorganic stability additive particles selected from the group consisting of: silica, talc, siloxane, and combinations thereof and is desirably capable of exhibiting substantial dielectric properties at least about 50° C. degrees above its transition temperature $T_f$ in a TCO. By use of the term "substantial dielectric properties," it is meant that the pellet composition is capable of maintaining a 500 volt (twice a rated voltage of about 240-250 volts) 60 Hz sinusoidal AC potential between two electrodes for at least one minute without conducting greater than 250 mA or in alternative aspects, may be measured as having a minimum insulation resistance across open electrodes of at least about 0.2 MΩ at two times a rated voltage DC (where a rated voltage is about 250 volts AC). The temperature above which a pellet material composition may or can no longer exhibit such substantial dielectric properties is known as the maximum dielectric capability temperature ($T_{cap}$), discussed above.

In other variations, a pellet material composition for use in a TCO according to certain aspects of the present teachings has one or more inorganic stability additive particles and thus exhibits substantial dielectric properties and has a maximum dielectric capability temperature ($T_{cap}$) of greater than or equal to about 130° C., optionally greater than or equal to about 140° C., optionally greater than or equal to about 150° C., optionally greater than or equal to about 160° C., optionally greater than or equal to about 170° C., optionally greater than or equal to about 180° C., optionally greater than or equal to about 190° C., optionally greater than or equal to about 200° C., optionally greater than or equal to about 210° C., optionally greater than or equal to about 220° C., optionally greater than or equal to about 225° C., optionally greater than or equal to about 230° C., optionally greater than or equal to about 240° C., optionally greater than or equal to about 250° C., optionally greater than or equal to about 260° C., optionally greater than or equal to about 270° C., optionally greater than or equal to about 280° C., optionally greater than or equal to about 290° C., optionally greater than or equal to about 300° C., optionally greater than or equal to about 310° C., optionally greater than or equal to about 320° C., optionally greater than or equal to about 330° C., optionally greater than or equal to about 340° C., optionally greater than or equal to about 350° C., optionally greater than or equal to about 360° C., optionally greater than or equal to about 370° C., optionally greater than or equal to about 380° C., optionally greater than or equal to about 390° C., optionally greater than or equal to about 400° C., and in certain aspects, greater than or equal to about 410° C. In certain embodiments, a pellet material composition for use in a TCO has one or more inorganic stability additive particles and thus has a maximum dielectric capability temperature ($T_{cap}$) that is greater than or equal to about 380° C. and less than or equal to about 410° C.

In certain embodiments, the one or more inorganic stability additive particles are optionally present in the improved thermal pellet composition at less than or equal to about 10% by weight of the total pellet composition, optionally at less than or equal to about 7% by weight of the total pellet composition, optionally at less than or equal to about 5% by weight of the total pellet composition, in certain embodiments, at less than or equal to about 4% by weight of the total pellet composition, optionally at less than or equal to about 3% of the total pellet composition, optionally at less than or equal to about 2.9% of the total pellet composition, optionally at less than or equal to about 2.75% of the total pellet composition, optionally at less than or equal to about 2.5% of the total pellet composition, optionally at less than or equal to about 2.25% of the total pellet composition, optionally at less than or equal to about 2%, optionally at less than or equal to about 1.9%, optionally at less than or equal to about 1.5% of the total pellet composition, optionally at less than or equal to about 1.25% of the total pellet composition, optionally less than or equal to about 1%, and in certain variations, less than or equal to about 0.8% by weight of the total pellet composition.

Further, in certain variations, the one or more inorganic stability additive particles are optionally present at greater than or equal to about 0.25% by weight of the improved thermal pellet composition, optionally at greater than or equal to about 0.5% by weight of the total pellet composition, optionally at greater than or equal to about 0.6% by weight of the total pellet composition, optionally at greater than or equal to about 0.7% by weight of the total pellet composition, optionally at greater than or equal to about 0.8% by weight of the total pellet composition, optionally at greater than or equal to about 0.9% by weight of the total pellet composition, in certain embodiments, at greater than or equal to about 1% by weight of the total pellet composition.

In certain variations of the present teachings, a pellet composition for a TCO comprises one or more organic compounds present at greater than or equal to about 95% by weight of the total pellet composition and one or more inorganic stability additive particles are present at less than or equal to about 5% by weight of the total pellet composition. In certain variations, a pellet composition for a TCO comprises one or more organic compounds present at greater than or equal to about 96% by weight of the total pellet composition and one or more inorganic stability additive particles are present at less than or equal to about 4%; and optionally present at less than or equal to about 3% by weight of the total pellet composition.

In other variations, the one or more inorganic stability additive particles comprise silica at greater than or equal to about 1% by weight to less than or equal to about 2% by weight of the total pellet composition. By silica, it is meant a composition that comprises silicon dioxide ($SiO_2$). Particularly suitable types of silica include amorphous silica ($SiO_2$) and fumed silica ($SiO_2$). Suitable silica particles may have an average particle size diameter of greater than or equal to about 1 μm to less than or equal to about 10 μm. Amorphous silica or silica gel, can be produced by the acidification of solutions of sodium silicate to produce a gelatinous precipitate, which is then washed and dehydrated to produce colorless microporous silica ($SiO_2$).

Fumed silica is typically prepared by introducing silicon tetrachloride to an oxygen rich hydrocarbon flame, thus producing a fumed $SiO_2$. Fumed silica (also known as pyrogenic silica) is a fine particulate form of silicon dioxide and is typically formed by exposing silicon tetrachloride to a flame or other heat source in the presence of oxygen to form a plurality of small amorphous silica particles. In certain variations, fumed silica particles may have an average particle size diameter of less than or equal to about 100 nm and optionally greater than or equal to about 5 nm to less than or equal to about 50 nm, by way of non-limiting example. In certain variations, a particularly suitable fumed silica has an average particle size of about 5 nm to 30 nm and a BET surface area of 100 to 300 $m^2/g$, which is commercially available from Wacker Silicones as the product HDK™ N20.

In other variations, the one or more inorganic stability additive particles comprise talc at greater than or equal to about 1% by weight to less than or equal to about 2% by weight of the total pellet composition. Talc comprises magnesium silicate, which may be in its hydrated form (magnesium silicate hydroxide). In various aspects, the talc comprises a plurality of particles having an average particle size diameter of greater than or equal to about 1 μm to less than or equal to about 50 μm. A suitable talc powder is available as Johnson's Baby Powder sold by Johnson & Johnson Consumer Products Company, which may have an average particle size of about 1 μm to 10 μm or optionally about 5 μm to about 10 μm.

In yet other variations, the one or more inorganic stability additive particles optionally comprise siloxane at greater than or equal to about 0.8% by weight to less than about 2.9% by weight of the total pellet composition. A "siloxane" is a polymer that has a basic backbone of silicon and oxygen with side constituent groups that may be the same or different, generally described by the structural repeating unit $(—O—SiR_1R_2—)_n$, where $R_1$ and $R_2$ may be the same or different side constituent groups, and n may be any value above 2 designating the repetition of the structural repeating unit (SRU) in the polymer backbone. $R_1$ and $R_2$ may be alkyl groups, such as methyl, ethyl and the like or alternatively aryl groups, such as phenyl. Siloxane polymers may be cross-linked and may include polyheterosiloxanes, where side groups and/or structural repeating units may be different entities or may be branched. As used herein, the siloxane materials are solid particles, for example, in powder form that can be dispersed in the pellet material composition. In certain aspects, the siloxane particles have an average particle size diameter of greater than or equal to about 5 μm to less than or equal to about 40 μm. In certain embodiments, a suitable siloxane powder is commercially available from Dow Corning as Dow Corning® Si Powder Resin Modifier 4-7051.

Therefore, in preferred variations, the thermally enhanced pellet material composition will include one or more organic compounds and further one or more inorganic stability additive particles, such that the inclusion of the inorganic stability additive particles enhances a maximum dielectric capability temperature ($T_{cap}$) of the pellet composition to at least 50° C. above the final temperature ($T_f$) (also referred to as actuation or transition temperature), where the internal contact breaks continuity in a thermal cutoff device due to structural changes in the pellet material composition, which in turn causes relaxation of compression mechanisms in a thermal cutoff device, for example. In certain variations, the pellet composition material including the one or more inorganic stability additive particles exhibits a maximum dielectric capability temperature ($T_{cap}$) optionally greater than or equal to about 60° C., optionally greater than or equal to about 70° C., optionally greater than or equal to about 80° C., optionally greater than or equal to about 90° C., optionally greater than or equal to about 100° C., optionally greater than or equal to about 110° C., optionally greater than or equal to about 120° C., optionally greater than or equal to about 130° C., optionally greater than or equal to about 140° C., optionally greater than or equal to about 150° C., optionally greater than or equal to about 160° C., optionally greater than or equal to about 170° C., optionally greater than or equal to about 160° C., optionally greater than or equal to about 180° C., optionally greater than or equal to about 190° C., optionally greater than or equal to about 200° C., optionally greater than or equal to about 210° C., optionally greater than or equal to about 220° C., optionally greater than or equal to about 230° C. above the transition temperature $T_f$ of the pellet material composition, and in certain aspects, the pellet material composition exhibits substantial dielectric properties at least about 226° C. above a threshold transition temperature $T_f$ of the pellet material composition.

Further, in certain variations, the pellet material composition includes one or more organic compounds, as well as one or more inorganic stability additive particles, such that the inclusion of the inorganic stability additive particles enhances a maximum dielectric capability temperature ($T_{cap}$) of the pellet composition to at least 20° C.; optionally at least about 30° C.; optionally at least about 40° C.; optionally at least about 50° C.; optionally at least about 60° C.; optionally at least about 70° C.; optionally at least about 80° C.; optionally at least about 90° C., and in certain variations at least 100° C., above an initial maximum dielectric capability temperature ($T_{cap}$) for a comparative pellet material composition that lacks the one or more inorganic stability additive particles, but otherwise has the same components.

In various aspects, the thermal cutoff devices of the present disclosure comprises a sealed housing having disposed therein a pellet material composition having a transition temperature $T_f$ or melting point of greater than or equal to about 120° C., optionally greater than or equal to about 121° C., optionally greater than or equal to about 125° C., optionally greater than or equal to about 130° C., optionally greater than or equal to about 135° C., optionally greater than or equal to about 140° C., optionally greater than or equal to about 144° C., optionally greater than or equal to about 145° C., optionally greater than or equal to about 150° C., optionally greater than or equal to about 152° C., optionally greater than or equal to about 155° C., optionally greater than or equal to about 160° C., optionally greater than or equal to about 165° C., optionally greater than or equal to about 167° C., optionally greater than or equal to about 170° C., optionally greater than or equal to about 175° C., optionally greater than or equal to about 180° C., optionally greater than or equal to about 184° C., optionally greater than or equal to about 185° C., optionally greater than or equal to about 190° C., optionally greater than or equal to about 192° C., optionally greater than or equal to about 195° C., optionally greater than or equal to about 200° C., optionally greater than or equal to about 205° C., optionally greater than or equal to about 210° C., optionally greater than or equal to about 215° C., optionally greater than or equal to about 220° C., optionally greater than or equal to about 225° C., optionally greater than or equal to about 230° C., and in certain aspects, greater than or equal to 235° C.

This transition temperature $T_f$ can also be referred to as a "melting-point"; however, the compounds in the pellet composition need not fully melt in a conventional sense to achieve separation of the electrical contacts to break the internal circuit and electrical continuity. As recognized by those of skill in the art, a melting-point temperature is one where compounds or compositions transform from solid to liquid phase, which may occur at a range of temperatures, rather than at a single discrete temperature point. In certain aspects, the high temperature thermal pellet may soften or sublimate rather than melting, by way of non-limiting example, to achieve the separation of electrical contacts to break the circuit. Melting-point temperatures can be measured in various apparatuses, such as those produced by Thomas Hoover, Mettler and Fisher-Johns companies. Differential Scanning calorimetry (DSC) techniques are also commonly used. Different measurement techniques may result in differing melting points, for example, optical analysis methods like Fisher-Johns measure light transmittance through a sample, a solid to liquid phase change. Early optical methods potentially suffered greater observer error versus more modern light beam transmittance melt point indicators. In addition, earlier techniques to determine melting point (before the use of digital high speed scan capabilities), rendered a broader range of results for melt points and other transitions. Likewise, before the advent of HPLC and other precise analytical techniques for determination of purity, the melt point of a sample, for example, measured by DSC, which measures heat flow behavior for example, crystallinity (solid-solid phase) changes as well as, solid to liquid phase changes, could show the solid-solid phase change of an impurity that may have been reported as a melt point, such as dehydration or breaking of hydroxyl bonds, as well as the solid-liquid phase change at the melt point for the material of interest. Thus, in various aspects, a composition can be selected for use in the thermal pellet that empirically exhibits a desirable physical change that will enable a pellet's physical transition without necessarily correlating to the predicted melting point ranges.

The pellet material composition thus comprises at least one organic compound, which generally has a melting point or melting point range near the pre-selected or desired transition temperature, and one or more inorganic stability additives that serve to minimize loss of dielectric properties and to minimize or prevent breakdown of the underlying at least one organic compound. Further, the thermal cutoff device including such a pellet material composition can optionally have a seal disposed in a portion of at least one opening of the housing that substantially seals the housing up to the transition temperature of the pellet material composition. As discussed above, the thermal cutoff device also comprises a current interruption assembly that is at least partially disposed within the housing. The current interruption assembly establishes electrical continuity in a first operating condition of the thermal cutoff device, which corresponds to an operating temperature of less than the transition temperature of the pellet material composition and that discontinues electrical continuity when the operating temperature exceeds the transition temperature.

The pellet material compositions may comprise one or more organic compounds or other additives that are selected to meet one or more of the following criterion. In certain aspects, organic compounds selected for use in the thermal pellet have a relatively high chemical purity. For example, in certain embodiments, desirable chemical candidates for the high temperature thermal pellet compositions have a range of purity levels from greater than or equal to about 95% up to greater than about 99%. In certain aspects, the organic compositions and additives selected for use in the thermal pellet compositions are particularly suitable for processing, handling, and toxicity characteristics. In certain embodiments, the organic chemical compounds or compositions selected for use in the pellet compositions have a median lethal dose toxicity value (LD50) less than or equal to about 220 mg/kg (ppm) for a mouse; less than or equal to about 400 mg/kg (ppm) for a rabbit; and less than or equal to about 350 mg/kg (ppm) for a rat. Further, in certain aspects, the selected organic chemical compound and additive compositions for the component compound desirably do not have documented carcinogenicity effects, mutagenicity effects, neurotoxicity effects, reproductive effects, teratogenicity effects, and/or other harmful health or epidemiological effects. In yet other aspects, the at least one organic compound and at least one inorganic stability additive particle for the pellet material compositions are selected such that alternate reactive residuals, reaction products formed during manufacture, decomposition products, or other species that might be formed during manufacture, storage, or use are absent, minimized, or are capable of purification and removal of such undesired species.

In certain aspects, the compositions selected for use in the pellet material composition exhibit long-term stability. By way of example, compositions are optionally selected to possess temperature or thermal stability, in other words, chemical compounds that show high levels of decomposition or volatility behavior within about 10° C., optionally within about 20° C., optionally within about 30° C., optionally within about 40° C., optionally within about 50° C., optionally within about 60° C., optionally within about 75° C., and in certain aspects, optionally within about 100° C. of the transition temperature $T_f$ or melting point of the organic compound may be rejected as viable candidates. Further, in certain embodiments, chemical compositions suitable for use as the present pellet material compositions preferably do not show a strong likelihood of heat-induced and age-progressive oxidation or decomposition. The inclusion of the inorganic stability additive particles at concentrations in accordance with various aspects of the present teachings does not significantly impact the transition temperature $T_f$ or melting point of the pellet composition; however, the presence of such inorganic stability additives does enhance the long-term stability of the pellet composition and minimizes substantial dielectric loss (as compared to a comparative pellet composition that includes the organic compound, but lacks the inorganic stability additive particles).

In certain alternative aspects, the present disclosure provides methods for enhancing thermal stability of a pellet composition for use in a thermally-actuated, current cutoff device. Such a method may comprise introducing one or more inorganic stability additive particles selected from the group consisting of: silica, talc, siloxane, and combinations thereof to an initial pellet composition that maintains its structural rigidity up to a transition temperature ($T_f$). After the introducing of the one or more inorganic stability additive particles to the initial pellet composition, an improved pellet composition is formed that exhibits the same $T_f$ as the initial pellet composition, but has a slower rate of aging at a temperature below the $T_f$ of at least 2%, as compared to the initial pellet composition. For example, in certain variations, the slower rate of aging may be slowed by at least 3% or more; optionally at least 4% or more; and in certain aspects 5% or more. The rate of aging may be tested at various different temperatures below the transition temperature $T_f$, as are well known in the art and described further below in the examples. Typical rates of aging can be tested at a temperature of $T_f$–40, $T_f$–25, $T_f$–20 $T_f$–15, $T_f$–10, or $T_f$–6, by way of non-limiting example. The slowed rate of aging and thermal stability conferred by certain aspects of the present teachings is particularly noticeable at higher temperatures near the $T_f$, such as at $T_f$–15 and $T_f$–10.

Suitable organic compound candidates for the pellet material composition of the TCO devices of the present disclosure optionally include the following characteristics in addition to those discussed above. In certain embodiments, organic chemicals having acidic structures, such as structures with multiple hydroxies or structures which might have ionic activity in an electrical field may be avoided or minimized. Further, certain organic compounds having side groups comprising sulfur are typically avoided. Similarly, compounds having bond structures that easily break down in an electrical field are preferably avoided in certain applications. Particularly suitable organic compounds, including those that exhibit relatively poor thermal stability but are otherwise suitable organic compounds for thermal pellet compositions include, but are not limited to, compounds selected from the group consisting of: m-phenylenedibenzoate, dimethyl terephthalate, p-acetotoluidide, benzanilide, 2',6',acetoxylidide, dimethylacetanilide, 7-hydroxy-4-methylcoumarin, coumarin, benzoguanimine, and combinations thereof. In certain high temperature TCO applications, the one or more organic compounds can be selected from the group consisting of: triptycene, 1-aminoanthroquinone, and combinations thereof, by way of non-limiting example. Other suitable organic materials are described in U.S. Publication No. 2010/0033295 to Kent et al. and U.S. Pat. No. 6,673,257 to Hudson, each of which is incorporated herein by reference in its entirety.

In various aspects, the pellet composition material comprises the one or more organic compounds cumulatively present at greater than or equal to about 90% by weight, optionally greater than or equal to about 93% by weight, optionally greater than or equal to about 94% by weight, optionally greater than or equal to about 95% by weight, optionally greater than or equal to about 96% by weight, optionally greater than or equal to about 97% by weight, optionally greater than or equal to about 98% by weight, optionally greater than or equal to about 98.5% by weight, optionally greater than or equal to about 99% by weight, optionally greater than or equal to about 99.1% by weight, and in certain aspects, greater than or equal to about 99.2% by weight organic compounds in the total pellet material composition.

In certain aspects, the one or more organic compounds or chemicals are processed to minimize evaporative loss, enhance crystallinity, and to obtain high purity levels. After introducing the one or more inorganic stability additives and other components to the one or more organic compounds, the material can be mixed, for example, by homogenously mixing the various ingredients to form a mixture. The mixture is processed into compacted shapes, such as pellets or grains, by application of pressure in a die or mold, by way of example. The structural integrity of pellets is desirably sufficient to withstand compressive forces of the TCO device, for example to withstand the applied force and bias to the TCO springs and encasement in a TCO assembly. By way of example, certain TCOs are capable of withstanding extended exposure to operating temperatures up to about 5° C. below the threshold or actuation temperature without breaking the electrical continuity of the circuit.

The pellet material compositions can be manufactured into any commercially available form suitable for use inside a housing of a TCO, including granules, pellets, spheres and any geometric shape known to those in the art. See for example, the exemplary cylindrical-shaped pellet 25 shown in FIG. 3.

In addition to the one or more organic compounds and the one or more inorganic stability additive particles described above, the thermal pellet composition optionally comprises one or more conventional pellet composition components selected from the group consisting of: binders, lubricants, press-aids, release agents, pigments, and combinations thereof, by way of example. These additives can be mixed with one or more of the inorganic stability additives and organic compounds. In certain aspects, the one or more components are cumulatively present at less than or equal to about 10% by weight of the total pellet composition.

A binder component, which generally softens (melts) at a temperature below the melting point of the organic component, is primarily utilized to assist in the production of pellets. While various binders known for pellet formation can be utilized, suitable binders include Dow Chemical D.E.R. 663U Epoxy Powder, polyethylene glycol, 1,3-benzenediol, epoxies, polyamides and combinations thereof, by way of non-limiting example. The binder is generally present in amounts of less than or equal to about 10% by weight based on the total composition; optionally at greater than or equal to about 1% by weight to less than or equal to about 5% by weight of the total composition.

Additionally, it may be desirable to employ a lubricant, release agent, or pressing aid to contribute to flowing and fill properties (into a die) when processing the thermal pellets. For example, among the numerous lubricants or press aids which have proven useful are calcium stearate, boron nitride, magnesium silicate and polytetrafluoroethylene (Teflon®), among others. The lubricant is generally present in an amount up to about 5% by weight based on the total pellet composition. It may also be desirable under certain applications to incorporate coloring agents, such as pigments, into the pellet composition to allow for rapid visual inspection of pellet condition. Various well known pigments which are compatible with the aforementioned thermal cutoff composition components and temperatures at which they operate may be employed. Pigments, when employed, are typically present in an amount up to about 2% by weight of the total pellet composition.

In certain embodiments, the thermal pellet composition may thus comprise one or more of such components cumulatively present at less than or equal to about 10% by weight of the total pellet composition. The remainder of such a thermal pellet composition comprises the one or more inorganic stability additive particles cumulatively present at less than or equal to about 4% by weight of the total pellet composition, along with the balance being one or more organic compounds. For example, in certain embodiments, the one or more organic compounds can be a single organic compound that is present at greater than or equal to about 93% by weight, optionally greater than or equal to about 95% by weight and in certain aspects, greater than or equal to about 96% by weight of the total pellet composition.

In certain embodiments, the pellet composition may consist essentially of the one or more organic compounds, the one or more inorganic stability additive particles, and one or more components selected from the group consisting of: binders, lubricants, press-aids, pigments, and combinations thereof. In yet other embodiments, the pellet composition may consist essentially of a single organic composition (as the primary ingredient to arrive at a predetermined, desired transition temperature $T_f$), a single inorganic stability additive (to enhance a maximum dielectric capability temperature ($T_{cap}$) and/or a maximum rated temperature $T_{max}$ to a second predetermined, desired temperature or otherwise enhance thermal stability like rate of aging), and optionally one or more components selected from the group consisting of: a binder, a press aid, a release agent, a pigment, or other conventional TCO pellet composition additives or diluents that do not impact the functional properties of the pellet. Thus, such a pellet composition may comprise minimal amount of diluents or impurities that do not substantially affect the transition temperature of the pellet composition or the performance of the TCO at operating temperatures above the threshold temperature.

As discussed above, some conventional TCO devices are not able to fulfill certain performance criteria, particularly long-term stability and robustness during an overshoot operating period (upon exposure to high-temperatures, after activation and current interruption in a safety device application). Furthermore, in both conventional TCO devices and HTTCO devices, suitable pellet compositions are those that exhibit dielectric properties after a temperature exceeds the pellet composition's transition temperature $T_f$, meaning that the pellet composition is capable of maintaining a 500 volt (2 times rated voltage of about 250 VAC) 60 Hz sinusoidal potential (VAC) between two electrodes at least about 50° C. above the transition temperature for at least one minute without conducting greater than 250 mA. However, the pellet compositions used in certain existing TCO devices and/or HTTCO devices are rated for temperatures at which the underlying composition only retains its dielectric properties in a range of about 100° C. of its transition temperature (where $T_f < T_{cap} \leq (T_f + 100° C.)$). In other words, both conventional TCO devices and HTTCO devices have not sufficiently fulfilled performance criteria for certain applications, where prolonged current and/or high-temperatures may continue to be experienced even after activation of the safety device. In certain embodiments, the improved pellet compositions are capable of maintaining a 500 volt, 60 Hz sinusoidal potential (VAC) at least 100° C. above the transition temperature for at least one minute without conducting greater than 250 mA (reflected by the $T_{cap}$ being at least 100° C. above the $T_f$).

An illustrative test to demonstrate performance of a pellet composition, for example to assess dielectric properties, includes forming the composition into a pellet, placing the pellet in a kiln or oven, and subjecting the pellet to a standard dielectric test and/or a standard insulation resistance test, while raising temperatures intermittently. While the pellet, if utilized in a TCO device, ideally meets or exceeds the aforementioned illustrative test protocol, it should be understood by those skilled in the art that the compositions are contemplated as being useful for both low and high voltage applications. Further, in certain aspects, the pellet compositions with substantial dielectric properties meet or exceed the Underwriters' Laboratory test UL1020 or IEC/EN 60691 standards, which are respectively incorporated herein by reference, see in particular Clauses 10.3 and 10.4 in Table 1, below. Notably, the $T_{max}$ test protocol is also described in Clause 11.3 contained in Table 1. In other aspects, a test to assess dielectric performance can include forming the composition into a pellet, placing the pellet (in a TCO device) in a kiln or oven, where the kiln or oven has a pre-selected temperature above $T_f$, and subjecting the pellet to an increasing AC voltage until breakdown.

In certain embodiments, TCO devices comprised of the thermally stable pellet compositions have substantial dielectric properties and meet one or more of such standards at the pre-selected temperature rating for the device. While the performance criteria is fully outlined in each of these standards, salient aspects of performance tests that demonstrate conformance to the IEC 60691, Third Edition standard are summarized in Table 1.

TABLE 1

| | | |
|---|---|---|
| I | Clause 10.6 Current Interrupt Test: | |
| A | | Sample is placed in a kiln at rated functioning temperature minus 10° C. for three minutes. |
| B | | Sample is tested at 110% of rated voltage and 150% of rated current until sample interrupts the test current. |
| II | Clause 10.7 Transient Overload (pulse) Test: | |
| A | | Samples are place in the current path of D.C. current pulses, with an amplitude of 15 times rated current for a duration of 3 ms with 10 s intervals are applied for 100 cycles. |
| III | Clause 11.2 Temperature Check ($T_f$): | |
| A | | Samples are placed in an oven at rated functioning temperature minus 10° C. until stable, the temperature is then increased steadily at 0.5° C./minute until all samples are opened, recording the temperature of opening to pass +0/−5° C. |
| IV | Clause 11.3 Maximum Temperature ($T_{max}$): | |
| A | | Samples are placed in a kiln at a specified temperature for 10 minutes, with the samples maintained at $T_{max}$ a dielectric test at 500 Vac with no breakdown, and an insulation resistance test at 500 Vdc with a minimum of 0.2 MΩ |
| V | Clause 11.4 Aging: | |
| A | | Samples are placed in a kiln at a predetermined temperature for three weeks. At the conclusion of this test at least 50% of samples shall not have functioned. |
| B | | Samples are then placed in a kiln at rated functioning temperature minus 15° C. for three weeks. At the conclusion of this test at least 50% of samples shall not have functioned. |
| C | | Samples are then placed in a kiln at rated functioning temperature minus 10° C. for two weeks. |
| D | | Samples are then placed in a kiln at rated functioning temperature minus 5° C. for one week. |
| E | | Samples are then placed in a kiln at rated functioning temperature minus 3° C. for one week. |
| F | | Samples are then placed in a kiln at rated functioning temperature plus 3° C. for 24 hours. |
| G | | This test is considered successful if all samples have functioned at the conclusion of step F. |
| VI | Clause 10.3/10.4 Room Temperature Dielectric and Insulation Resistance: | |
| A | | All test samples must complete and comply with a dielectric test at 500 Vac with no breakdown, and an insulation resistance test at 500 Vdc with a minimum of 0.2 MΩ |

Example 1

In accordance with various aspects of the present disclosure, a pellet material composition for use in a TCO exhibiting substantial dielectric properties (having a maximum dielectric capability temperature ($T_{cap}$) of equal to or greater than about 380° C.) due to the inclusion talc and fumed silica inorganic stability additive particles is formed as follows. A pellet is formed by mixing about 980 g (95.6%±0.5%) of 2',6'-acetoxylidide (commercially available from Sigma-Aldrich at 97% purity); about 10 g of fumed silica (0.98%±0.5%) (commercially available from Wacker Silicones as HDK™ N20) and 10 g of talc (0.98%±0.5%) (commercially available as Johnson's Baby Powder) with about 25 g of colorants, binders, and or release agents (2.4%±0.5%). The mixture is then screened and folded by hand, followed by processing on a standard powder compaction press (widely available from pharmaceutical equipment suppliers). After processing in the compaction press, powder is fed through a gated powder flow control system and spread evenly over a rotary die table. The powder fills the dies (for the pellets) and punches/presses the powder in the dies under approximately 1 ton to 4 tons pressure to form a compacted powder pellet. Here, a density of the compacted pellet is 29 pellets per gram to 50 pellets per gram.

Next, the pellet is placed into a high-conductivity metal, closed-end cylinder with an inner diameter approximately the outer perimeter of the TCO pellet. The closed end of the cylinder is staked shut with an axial conductive metal lead protruding out of the cylinder. Other components are loaded atop the pellet in a stacked fashion depending on the end-use requirements of the TCO. A sub-assembly comprised of a non-conductive ceramic bushing with an axial bore hole and a conductive metal lead which has been inserted in the open bore and mechanically restrained into a permanent one-piece assembly by deformation of the metal lead is inserted into the open end of the TCO cylinder. The stacked components are compressed into the cylinder by the ceramic, isolated lead assembly and the rim of the open end of the cylinder is mechanically rolled over the ceramic bushing to permanently enclose the internal components in the TCO cylinder. An epoxy-type sealant is applied to the rolled over open end of the cylinder, the ceramic bushing and the base of the isolated lead.

The assembled TCO is then cured for about 9 hours at 48° C. to 60° C. under 0% RH to 85%. Next, the operating temperature of the TCO is raised to a final or transition temperature, here the $T_f$ is 184° C. The temperature is held constant for ten minutes while the TCO is exposed to a dielectric withstand test and then an insulation test. The salient features of each test are summarized in Table 1, above. Also as mentioned above, the dielectric withstand test and insulation resistance test meet the requirements of IEC 60691 $3^{RD}$ Ed, Clause 10.3 and Amendment 1 and IEC 60691 $3^{RD}$ Ed, Clause 10.4 and Amendment 1, respectively. Ideally, all test samples complete and comply with a dielectric test at 500 Vac with no breakdown, and an insulation resistance test at 500 Vdc with a minimum of 0.2 MΩ Further, the TCO ideally should not exhibit any type of damage. For purposes of the dielectric withstand test, "breakdown" means a sudden and complete drop in test voltage or the inability to maintain the specified test voltage.

Conventional seals, like an epoxy seal, generally break down or degrade so that the seal is damaged/ineffective at temperatures of about 380° C. and above. With the pellet composition of this Example, the underlying epoxy seal of the TCO typically becomes damaged and/or ineffective after reaching a temperature of between about 380° and 410°, thereby rendering further improvements to $T_{max}$ moot. A maximum temperature rating $T_{max}$ for a comparative pellet (that is the same as that described above, except that the inorganic stability additives of the present teachings like talc or fumed silica are omitted), is generally commercially limited to about 210° C. (an overshoot temperature range of only about 26° C. above the $T_f$ of 184° C. prior to potential loss of dielectric properties).

Therefore, it is surprisingly found that the addition of the talc, silica, like fumed silica, or siloxane stability additive particles (for example, in embodiments with concentrations of about 2% talc or about 1% fumed silica by weight of the total pellet composition) provided an increased maximum dielectric capability temperature ($T_{cap}$) of at least about 380° C. to about 410° C. (improving an overshoot temperature range at least 195° C. over the transition temperature). For example, a conventional TCO rated for a transition temperature $T_f$ of 184° C. and lacking any stability additives according to the present teachings will typically pass a 500V test of dielectric and insulation resistance at, up to, and including 240° C. For safety reasons, a margin of about 30° C. is subtracted from that maximum dielectric capability temperature ($T_{cap}$) of about 240° C. to provide a maximum temperature rating. Thus, such a conventional TCO has a 210° C. $T_{max}$ rating, although it can be expected to pass and have a maximum dielectric capability temperature ($T_{cap}$) of about 240° C. When such a TCO has inorganic stability additives introduced in accordance with certain aspects of the present teachings; however, while still having a transition temperature $T_f$ of 184° C., such an embodiment of the inventive TCO has a maximum temperature rating $T_{max}$ of 380° C. (although such an inventive TCO will typically pass a 500V test of dielectric and insulation resistance at, up to, and including 410° C.). Such a result is surprising and unexpected. While not limiting the present teachings to any particular theory, it is believed certain inorganic stability additive particles additives, like fumed silica, talc, and siloxane particles may block the current that may pass from the organic substituents, thereby limiting the chemical available for voltage breakdown.

Example 2

Various pellet material compositions for use in a TCO are prepared as described in Example 1 above with the materials set forth in Table 2, below. The number of pellet samples of each of the pellet compositions in Table 2 is compared to the same or a similar number of pellet compositions lacking the specified inorganic additives to provide the effect described below. While certain potential inorganic additives appear to provide unexpected beneficial or positive effects, others resulted in varying negative results. These results are displayed below in Table 2. Further, it should be noted that a conventional comparative maximum rated temperature ($T_{max}$) is provided for each given pellet composition (for a comparative pellet composition having an identical composition, but lacking any inorganic stability additives), although the actual maximum dielectric capability temperature ($T_{cap}$) has not been tested in these examples.

TABLE 2

| Ex. | PELLET COMPOSITION | WT. % (AMOUNT) | TRANSITION TEMP. ($T_F$) (° C.)/ CONVENTIONAL COMPARATIVE MAXIMUM TEMP. ($T_{max}$) (° C.) | EFFECT | # OF PELLETS | PERFORMANCE AS COMPARED TO COMPARATIVE COMPOSITION LACKING INORGANIC ADDITIVE (S) |
|---|---|---|---|---|---|---|
| A | 2',6',acetoxylidide<br>Fumed Silica<br>Talc<br>Binder, pigments, and lubricants | 93.3% (980 g)<br>1.9% (~20 g)<br>1.9% (~20 g)<br>Balance | 184/210 | Positive | 60 | Reduced the $T_f$ non-conformance rate from 1.3% to 1%. |
| B | 2',6',acetoxylidide<br>Fumed Silica<br>Talc<br>Binder, pigments, and lubricants | 93.3% (980 g)<br>1.9% (~20 g)<br>1.9% (~20 g)<br>Balance | 184/210 | Positive | 40 | Increased the pass rate for $T_{max}$ at 500v300° C. from 85% to 100%. |
| C | M-phenylenedibenzoate<br>Fumed Silica<br>Talc<br>Binder, pigments, and lubricants | 94.3% (965 g)<br>1% (~10 g)<br>1% (~10 g)<br>Balance | 121/160 | Positive | 15 | A rate of aging at $T_f$-15 is slowed by 5% to 7%. |
| D | M-phenylenedibenzoate<br>Fumed Silica<br>Talc<br>Binder, pigments, and lubricants | 93.4% (965 g)<br>1.5% (~15 g)<br>1.5% (~15 g)<br>Balance | 121/160 | Positive | 15 | A rate of aging at $T_f$-10 is slowed by 2% to 5%. |
| E | P-acetotoluidide<br>Siloxane Powder<br>Lubricant | 99% (1000 g)<br>0.8% (~8 g)<br>Balance | 152/205 | Positive | 10 | Increased the breakdown voltage at 230° C. by 9%. |
| F | 7-Hydroxy-4-methylcoumarin<br>Siloxane Powder<br>Pigment and lubricant | 98.7% (995 g)<br>0.8% (~8 g)<br>Balance | 192/210 | Positive | 10 | Increased the breakdown voltage at 240° C. by 22%. |
| G | 7-Hydroxy-4-methylcoumarin<br>Siloxane Powder<br>Pigment and lubricant | 96.5% (995 g)<br>3% (~30 g)<br>Balance | 192/210 | Positive | 10 | Increased the breakdown voltage at 240° C. by 10%. |
| H | Dimethyl terephthalate<br>Fumed Silica<br>Talc<br>Pigments and lubricant | 94.5% (990 g)<br>1.9% (~20 g)<br>1.9% (~20 g)<br>Balance | 144/240 | Positive | 20 | Increased a pass rate for $T_{max}$ at 500v380° C. from 75% to 90%. |
| I | Dimethyl terephthalate<br>Fumed Silica<br>Talc<br>Pigments and lubricant | 94.5% (990 g)<br>1.9% (~20 g)<br>1.9% (~20 g)<br>Balance | 144/240 | Positive | 20 | A rate of aging at $T_f$-15 is slowed by 5% to 10%. |
| J | Dimethyl terephthalate<br>Fumed Silica<br>Talc<br>Pigments and lubricant | 96.4% (990 g)<br>1% (~10 g)<br>1% (~10 g)<br>Balance | 144/240 | Positive | 20 | A rate of aging at $T_f$-15 is slowed by 3.5%. |
| K | Dimethyl terephthalate<br>Mica powder<br>Pigments and lubricant | 93.6% (990 g)<br>5% (~50 g)<br>Balance | 144/240 | Negative | 10 | Reduced current interrupt pass rate by 25%. |
| L | Dimethyl terephthalate<br>Mica powder<br>Pigments and lubricant | 85.5% (990 g)<br>15% (~150 g)<br>Balance | 144/240 | Negative | 10 | Reduced current interrupt pass rate by 25%. |
| M | P-acetotoluidide<br>Siloxane powder<br>Lubricant | 96.9% (1000 g)<br>2.9% (~30 g)<br>Balance | 152/205 | Negative | 10 | Reduced breakdown voltage at 230° C. by 20%. |
| N | P-acetotoluidide<br>Zeolite powder<br>Lubricant | 98.8% (1000 g)<br>1% (~1 g)<br>Balance | 152/205 | Negative | 10 | Reduced breakdown voltage at 230° C. by 19%. |
| O | P-acetotoluidide<br>Zeolite powder<br>Lubricant | 96.9% (1000 g)<br>2.9% (~30 g)<br>Balance | 152/205 | Negative | 10 | Reduced breakdown voltage at 230° C. by 25%. |
| P | P-acetotoluidide<br>Diatomite powder<br>Lubricant | 98.8% (1000 g)<br>1% (~1 g)<br>Balance | 152/205 | Negative | 10 | Reduced breakdown voltage at 230° C. by 29%. |
| Q | P-acetotoluidide<br>Diatomite powder<br>Lubricant | 96.9% (1000 g)<br>2.9% (~30 g)<br>Balance | 152/205 | Negative | 10 | Reduced breakdown voltage at 230° C. by 25%. |
| R | P-acetotoluidide<br>Carapace powder<br>Lubricant | 98.8% (1000 g)<br>1% (~1 g)<br>Balance | 152/205 | Negative | 10 | Reduced breakdown voltage at 230° C. by 25%. |
| S | P-acetotoluidide<br>Carapace powder<br>Lubricant | 96.9% (1000 g)<br>2.9% (~30 g)<br>Balance | 152/205 | Negative | 10 | Reduced breakdown voltage at 230° C. by 4%. |
| T | 7-Hydroxy-4-methylcoumarin<br>Zeolite powder<br>Pigment and lubricant | 98.5% (995 g)<br>1% (~10 g)<br>Balance | 192/210 | Negative | 10 | Reduced breakdown voltage at 240° C. by 25%. |

TABLE 2-continued

| Ex. | PELLET COMPOSITION | WT. % (AMOUNT) | TRANSITION TEMP. ($T_F$) (° C.)/ CONVENTIONAL COMPARATIVE MAXIMUM TEMP. ($T_{max}$) (° C.) | EFFECT | # OF PELLETS | PERFORMANCE AS COMPARED TO COMPARATIVE COMPOSITION LACKING INORGANIC ADDITIVE (S) |
|---|---|---|---|---|---|---|
| U | 7-Hydroxy-4-methylcoumarin<br>Zeolite powder<br>Pigment and lubricant | 96.5% (995 g)<br>2.9% (~30 g)<br>Balance | 192/210 | Negative | 10 | Reduced breakdown voltage at 240° C. by 49%. |
| V | Dimethyl terephthalate<br>Fumed Silica<br>Pigments and lubricant | 95% (~95 g)<br>5% (~5 g)<br>Balance | 144/240<br>Not applicable | Negative | 10 | The addition of 5% silica resulted in inability to process material so as to form a pellet. |

Examples A-J indicate that the test results are positive and thus advantageously improve performance and thermal stability for the thermal pellet material compositions, while Comparative Examples K-V had somewhat negative test results that diminished or failed to improve performance under similar conditions. Thus, in various embodiments, the thermal pellet material composition comprises one or more inorganic stability additive particles selected from the group consisting of: silica, talc, siloxane, and combinations thereof, which unexpectedly improve enhanced thermal stability of the thermal pellet material composition, as reflected by Examples A-J. Such improved thermal stability above the transition temperature may be reflected by one or more of the following non-limiting benefits: (i) increasing a maximum dielectric capability temperature ($T_{cap}$), above which the pellet can lose its dielectric and/or insulation resistance properties and/or begins to conduct electrical current in a typical TCO device (as described further herein); (ii) increasing a maximum temperature ($T_{max}$) rating for a pellet composition; (iii) increasing breakdown voltages for the open TCO device at a predetermined temperature, as well as improving pellet stability below the transition temperature ($T_f$) (iv) slowing a rate of aging at temperatures near $T_f$(e.g., at a test temperature within 10 or 15 degrees of $T_f$, $T_f$−10° or $T_f$−15°).

Of course, as appreciated by those of skill in the art, different additives and organic compounds for the pellet composition may provide different results, and thus these experiments are exemplary of certain preferred embodiments. Thus, in certain variations, like those of Examples A, C-D, and H-J, the one or more inorganic stability additive particles comprise silica at greater than or equal to about 1% by weight to less than or equal to about 2% by weight of the total pellet composition to provide performance benefits indicated, as well as thermal stability. In other variations, the one or more inorganic stability additive particles comprise talc at greater than or equal to about 1% by weight to less than or equal to about 2% by weight of the total pellet composition, like those of Examples A, C-D, and H-J.

In yet other variations, the one or more inorganic stability additive particles comprise siloxane powder at greater than or equal to about 0.8% by weight to less than about 3% by weight of the total pellet composition, as shown in Figure B and Examples E-G. It should be noted that Comparative Example M (where the organic compound is p-acetotoluidide) has siloxane powder in an amount of 3% and demonstrates a reduced breakdown voltage at 230° C. by about 20%, thus, in certain embodiments, the amount of siloxane powder provided is less than 2.9% by weight of the total amount to improve breakdown voltage passage rates. Furthermore, with regard to Example V, an upper limit of the fumed silica additive at about 5% occurs because the material cannot be processed to form a compressed pellet in a thermal cutoff device.

Regarding mica powder, zeolite powder, diatomaceous earth or diatomite powder, and carapace powder in Comparative Examples K-L and N-U, while these inorganic additives (with the exclusion of carapace powder that is organic) may promote or enhance thermal stability in certain applications, for the pellet materials and concentrations tested in Table 2, it appears that the presence of such additives diminished performance. In contrast, the silica, talc, and siloxane powders according to various aspects of the present technology serve as inorganic stability additives that contribute to the thermal pellet compositions high temperature capabilities and superior dielectric properties. This result is unexpected and surprising. Notably, it is unexpected and surprising that silica, talc, and siloxane powders improved thermal pellet performance in the manner observed, while other inorganic additives like mica, zeolite, diatomaceous earth and carapace powder did not. Zeolites are crystallized minerals made of alumina and silica. Calcined diatomaceous earth is approximately 90% silica. Mica is a lamellar silicate. Carapace powder (although organic) has high surface area and is highly adsorbent but not silica based. However, while zeolites, calcined diatomaceous earth, and mica all contain silicon dioxide, none of these compounds appeared to bestow the positive effects that are observed from siloxane particles, fumed silica, and/or talc. The benefit from certain inventive inorganic stability additives like fumed silica, talc and siloxanes would be expected to be seen with zeolites, mica and diatomaceous earth, if silica content is the only factor conferring the benefit. Thus, silica content is not a determinate factor improving the high temperature stability behavior of TCOs.

Furthermore, organic carapace powder has high surface area and is highly adsorbent; however, it too did not perform as well as any of the silica, talc, and siloxane powders. Therefore, high surface area and high adsorbency is not the only factor resulting in improved performance and thermal stability. While not limiting the present teachings to any particular theory, it is hypothesized that the amorphous character of the fumed silica and siloxane particles may contribute to their success as an inorganic additive that improves the thermal stability of the organic TCO material. This amorphous character contrasts with the regular geometric shapes of zeolites and diatomaceous earth and the lamellar structure of mica. Further, it is believed that talc not only has beneficial dielectric properties by itself, but may further enhance the resultant dielectric properties by facilitating dispersion of the fumed silica or siloxane in the organic compound(s) of the TCO composition.

Example 3

In this example, the aging of TCOs employing certain inorganic stability additive particles are compared to comparative TCOs that had the same composition with the exception that no inorganic stability additive particles are employed. TCOs are made in accordance with certain aspects of the present teachings that have substantial dielectric properties and thermal stability. Pellets are formed by mixing about 987 g of dimethyl terephthalate (94.3%±0.5%) (commercially available from Sigma-Aldrich at 99% purity); about 20 g of fumed silica (1.9±0.5%) (Wacker Silicones HDK™ N20) and 20 g of talc (1.9%±0.5%) (Johnson's® Baby Powder) with about 20 g of colorants and lubricants/release agents (1.9%±0.5%). The mixture is pelletized in a method like that described in Example 1, above. These pellets have a transition temperature ($T_f$) of about 144° C. Comparative pellets are also formed by using the recipe immediately above, except omitting the fumed silica and talc components, and likewise have a $T_f$ of 144° C.

Figure 6:
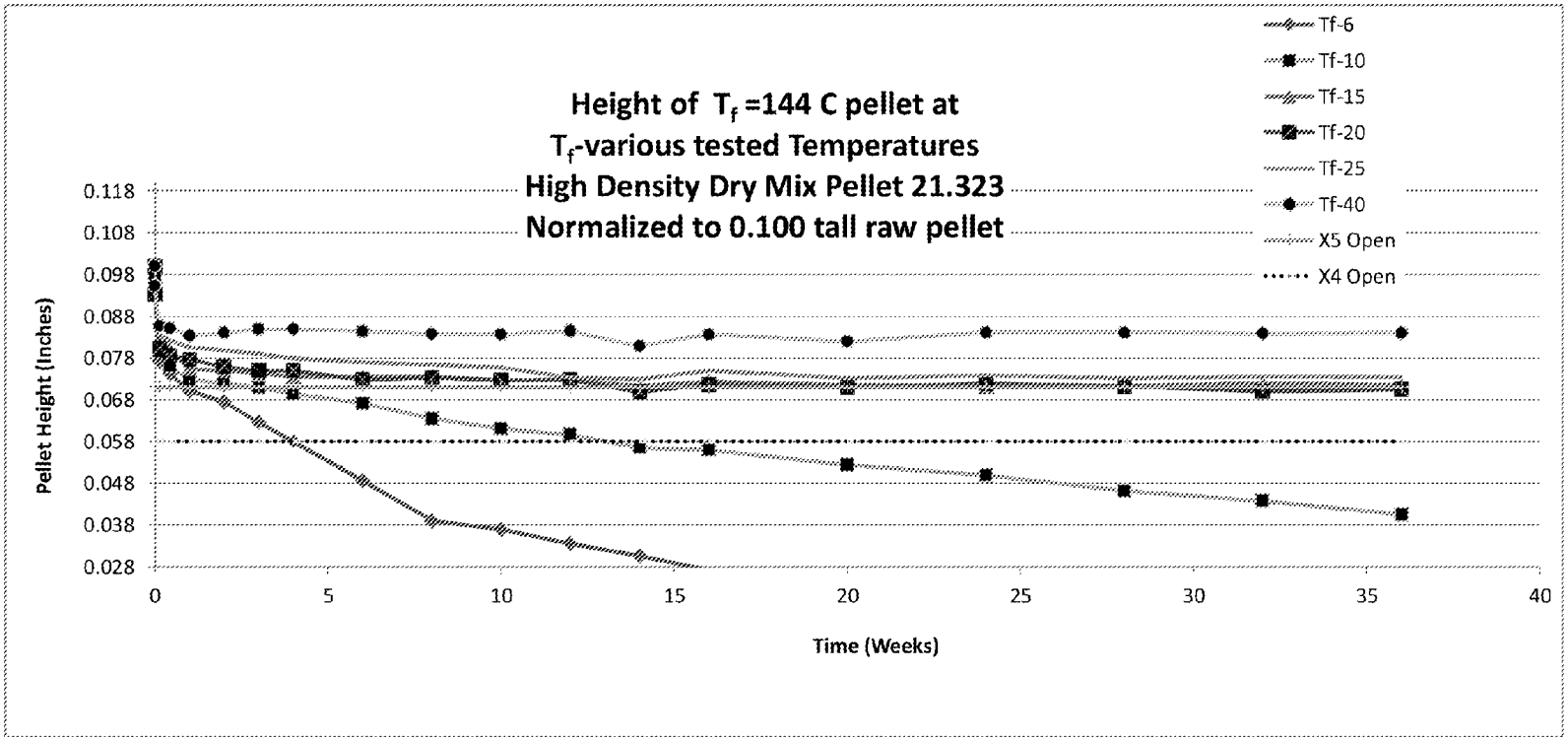
FIG. 6 is a graph showing pellet height over time for first comparative pellet compositions of Example 3, comprising dimethyl terephthalate, but lacking inorganic stability additives, prepared as a high density lab pellet dry mixture.
Figure 7:
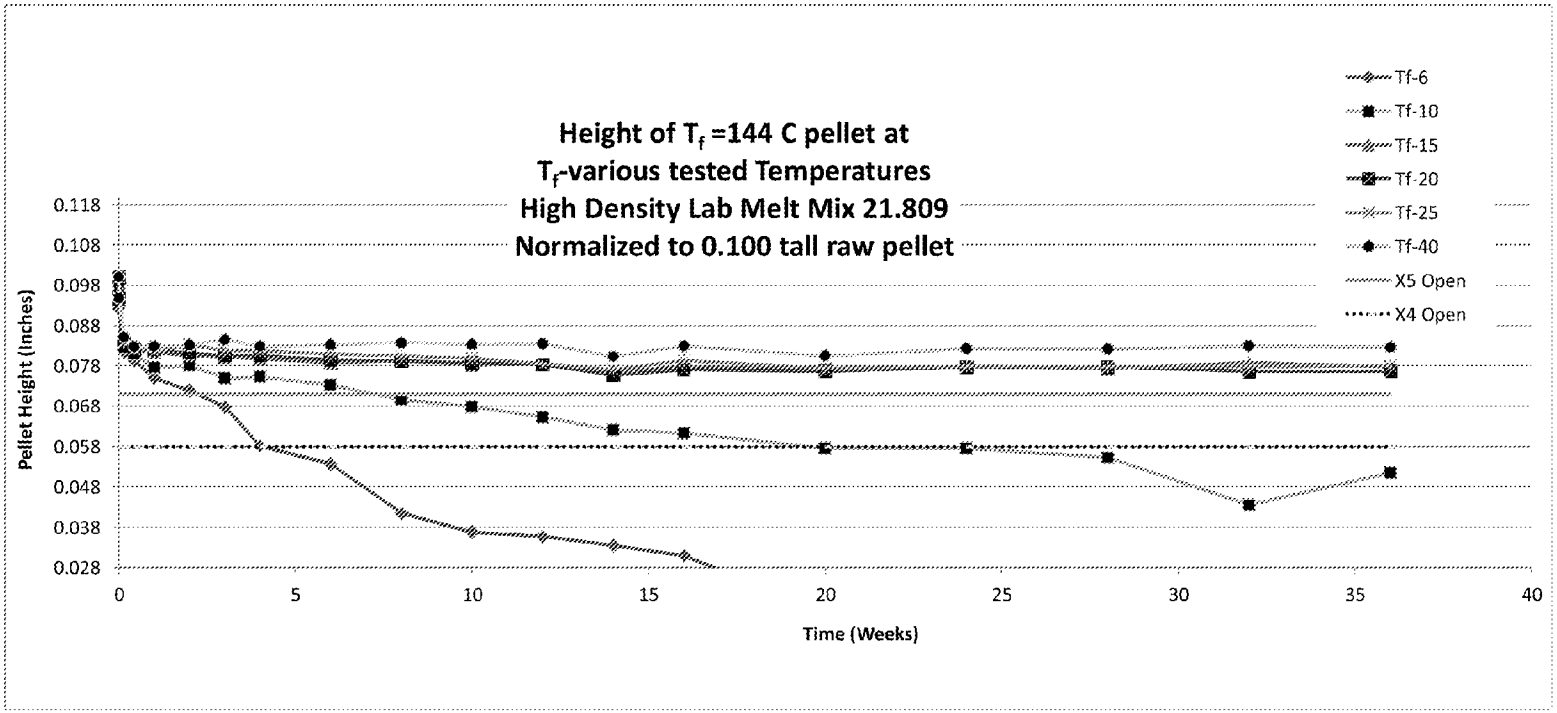
FIG. 7 is a graph showing pellet height over time for second comparative pellet compositions of Example 3, comprising dimethyl terephthalate but lacking inorganic stability additives, prepared as a high density lab pellet melt.

These pellets are placed in several test thermal cutoff devices. The TCO device temperatures are kept constant at a constant temperature, namely 6° C., 10° C., 15° C., 20° C., 25° C., or 40° C. from the $T_f$ of the pellet material composition. A height of each pellet both with the additives and a comparative composition without the additives is recorded weekly. Thus, comparative pellet examples having a high density (dry mix pellet) of 21.323 and 21.809 are respectively normalized to 0.100 inches tall and are shown in FIGS. 6-7, while examples of pellets in accordance with certain aspects of the present teachings having the 2% silica and 2% talc are shown in FIGS. 8-9 (likewise normalized to 0.100). These figures show that the pellet heights of the pellets with additives decrease more quickly than their comparative counterparts lacking such additives when the temperatures are held at or within 15° C. of the $T_f$ (which relates to a rate of aging); however, at temperatures held at or above 20° C. near the $T_f$, the pellets containing the additives display pellet height degradation values better than their additive-less counterparts.

Thus, in certain aspects, the present disclosure provides a pellet composition for use in a thermally-actuated, current cutoff device. The pellet composition comprises one or more organic compounds; and one or more inorganic stability additive particles selected from the group consisting of: silica, talc, siloxane, and combinations thereof. Such a pellet composition is in a solid phase and maintains its structural rigidity up to a transition temperature ($T_f$). The pellet composition also has a maximum dielectric capability temperature ($T_{cap}$) above which the pellet composition loses substantial dielectric properties and conducts current that is about 50° C. or greater than the $T_f$. In certain variations, the pellet composition maintains substantial dielectric properties at least about 20° C. higher than the $T_f$; optionally at least about 30° C. higher than the $T_f$; optionally at least about 40° C. higher than the $T_f$; optionally at least about 50° C. higher than the $T_f$. In certain variations, the pellet composition maintains substantial dielectric properties at least about 70° C. higher than the $T_f$; optionally at least about 80° C. higher than the $T_f$; optionally at least about 90° C. higher than the $T_f$; and in certain aspects optionally at least about 100° C. higher than the $T_f$. In certain aspects, the transition temperature $T_f$ is greater than or equal to about 120° C. and furthermore, the maximum dielectric capability temperature ($T_{cap}$) is at least about 100° C. greater than the $T_f$. In certain variations, maximum dielectric capability temperature ($T_{cap}$) is at least about 200° C. greater than the $T_f$.

The one or more organic compounds in the pellet composition are optionally present at greater than or equal to about 93% by weight of the total pellet composition, optionally at greater than or equal to about 94%, optionally at greater than or equal to about 95%, and in certain aspects at greater than or equal to about 96%, while the one or more inorganic stability additive particles are present at less than or equal to about 4%, optionally at less than or equal to about 3%, and in certain variations, less than or equal to about 2% by weight of the total pellet composition. As discussed above, other conventional materials, like binders, pigments, press-aids, and the like may also be provided in the pellet composition at the concentrations specified earlier.

In certain embodiments, when the one or more inorganic stability additive particles comprise siloxane, such siloxane particles are present at less than or equal to about 2.9%. Thus, in certain variations, the one or more inorganic stability additive particles comprises siloxane at greater than or equal to about 0.8% by weight to less than about 2.9% by weight of the total pellet composition. In other embodiments, the one or more inorganic stability additive particles comprises silica at greater than or equal to about 1% by weight to less than or equal to about 2% by weight of the total pellet composition. In yet other embodiments, the one or more inorganic stability additive particles may comprise talc at greater than or equal to about 1% by weight to less than or equal to about 2% by weight of the total pellet composition. In certain variations, the one or more inorganic stability additive particles comprises both silica and talc and thus can comprise silica at greater than or equal to about 1% by weight to less than or equal to about 2% by weight of the total pellet composition and talc at greater than or equal to about 1% by weight to less than or equal to about 2% by weight of the total pellet composition.

In certain aspects, the pellet composition consists essentially of the one or more organic compounds, the one or more inorganic stability additive particles, and one or more additional components selected from the group consisting of: binders, lubricants, press-aids, pigments, and combinations thereof. The one or more components in addition to the inorganic stability additive particles and the organic compounds are cumulatively present at less than or equal to about 10% by weight of the total pellet composition, while the one or more inorganic stability additive particles are cumulatively present at less than or equal to about 4% by weight of the total pellet composition and the balance is the organic compounds. For example, in certain aspects, the one or more organic compounds may be a single organic compound, e.g., a crystalline compound, present at greater than or equal to about 93% by weight of the total pellet composition. Suitable organic compounds are selected from the group of m-phenylenedibenzoate, dimethyl terephthalate, p-acetotoluidide, benzanilide, 2',6',acetoxylidide, dimethylacetanilide, 7-hydroxy-4-methylcoumarin, coumarin, benzoguanimine, and combinations thereof, by way of non-limiting example.

In other aspects, a pellet composition is provided by the present teachings for use in a thermally-actuated, current cutoff device that comprises one or more organic compounds and one or more inorganic stability additive particles present at less than about 3% by weight of the total pellet composition. The one or more inorganic stability additive particles are selected from the group consisting of: silica, talc, siloxane, and combinations thereof. The pellet composition is in a solid phase and maintains its structural rigidity up to a transition temperature ($T_f$). However, the pellet composition also has a maximum dielectric capability temperature ($T_{cap}$) of greater than or equal to about 380° C., a point above which the pellet composition can lose substantial dielectric properties and conducts current. In certain embodiments, the maximum dielectric capability temperature ($T_{cap}$) of certain embodiments of the inventive pellet compositions comprising the one or more inorganic stability additives is greater than or equal to about 380° C. and less than or equal to about 410° C. As noted above, certain pellet compositions described herein have not only an improved maximum dielectric capability temperature ($T_{cap}$), but also an improved maximum rated temperature ($T_{max}$) as well. The one or more inorganic stability additive particles in the pellet composition can optionally comprise silica, talc, or both silica and talc independently present in the thermal pellet composition at greater than or equal to about 0.5% by weight to less than or equal to about 5% by weight of the total pellet composition, optionally at greater than or equal to about 0.75% by weight to less than or equal to about 4% by weight of the total pellet composition and in certain variations at less than or equal to about 3%. In other variations, the one or more inorganic stability additive particles can optionally comprise silica present in the thermal pellet composition at greater than or equal to about 1% by weight to less than or equal to about 2% by weight of the total pellet composition, while talc may be present at greater than or equal to about 1% by weight to less than or equal to about 2% by weight of the total pellet composition. In another embodiment, the one or more inorganic stability additive particles comprises siloxane at greater than or equal to about 0.8% by weight to less than about 2.9% by weight of the total pellet composition. Particularly suitable organic compounds include those selected from the group of m-phenylenedibenzoate, dimethyl terephthalate, p-acetotoluidide, benzanilide, 2',6',acetoxylidide, dimethylacetanilide, 7-hydroxy-4-methylcoumarin, coumarin, benzoguanimine, and combinations thereof. Again, the present disclosure contemplates that such a pellet composition may consist essentially of the one or more organic compounds, the one or more inorganic stability additive particles, and one or more components selected from the group consisting of: binders, lubricants, press-aids, pigments, and combinations thereof.

In one particular embodiment, the present disclosure provides a pellet composition for use in a thermally-actuated, current cutoff device that comprises an organic compound comprising 2',6',acetoxylidide. The pellet composition of this embodiment further comprises one or more inorganic stability additive particles comprising fumed silica and talc. The pellet composition has a transition temperature ($T_f$) of greater than or equal to about 175° C. to less than or equal to about 190° C., optionally greater than or equal to about 181° C. to less than or equal to about 187° C., and in certain embodiments a $T_f$ of about 184° C.

In one variation, the 2',6',acetoxylidide organic compound is present at greater than or equal to about 92 to less than or equal to about 95%, optionally at greater than or equal to about 93 to less than or equal to about 94%, and in certain variations at about 93.3% by weight of the total pellet composition. In certain variations, fumed silica is optionally present at less than or equal to about 5% and talc is optionally present at less than or equal to about 5%. For example, in certain variations, the fumed silica is present at greater than or equal to about 1 to less than or equal to about 3%, optionally at greater than or equal to about 1.5 to less than or equal to about 2.5%, and in certain variations at about 1.9% by weight of the total pellet composition. Likewise, the talc is present at greater than or equal to about 1 to less than or equal to about 3%, optionally at greater than or equal to about 1.5 to less than or equal to about 2.5%, and in certain variations at about 1.9% by weight of the total pellet composition. A balance of the pellet composition comprises binder, pigments, and lubricants.

In such embodiments, the pellet composition consistently and repeatedly exhibits a maximum dielectric capability temperature ($T_{cap}$), above which the pellet composition may lose substantial dielectric properties and conducts current of at least greater than or equal to about 50° C. greater than the $T_f$. It is noted that as discussed above, the actual maximum dielectric capability temperature ($T_{cap}$) for the pellet composition may be significantly higher than the rated maximum temperature ($T_{max}$). Further, in such embodiments, the pellet composition consistently and repeatedly has a maximum dielectric capability temperature ($T_{cap}$) of greater than or equal to about 205° C.; optionally greater than or equal to about 207° C.; and in certain variations optionally greater than or equal to about 210° C.

As noted above, for such a thermally stable pellet composition comprising 2',6',acetoxylidide and talc and fumed silica as the inorganic stability additives, an increased pass rate for $T_{max}$ at 500 v 300° C. improves from 85% to 100% (for 40 samples testing in Example 2 and as set forth in Table 2).

In another variation, the present disclosure provides a pellet composition for use in a thermally-actuated, current cutoff device that comprises an organic compound comprising m-phenylenedibenzoate. The pellet composition of this embodiment further comprises one or more inorganic stability additive particles comprising fumed silica and talc. The pellet composition has a transition temperature ($T_f$) of greater than or equal to about 115° C. to less than or equal to about 130° C., optionally greater than or equal to about 118° C. to less than or equal to about 124° C., and in certain embodiments a $T_f$ of about 121° C.

In one variation, the m-phenylenedibenzoate organic compound is present at greater than or equal to about 93 to less than or equal to about 97%, optionally at greater than or equal to about 93 to less than or equal to about 96%, and in certain variations at about 94.3% by weight of the total pellet composition. The fumed silica is present at greater than or equal to about 0.5 to less than or equal to about 2%, optionally at greater than or equal to about 1 to less than or equal to about 1.5%, and in certain variations at about 1% by weight of the total pellet composition. Likewise, the talc is present at greater than or equal to about 0.5 to less than or equal to about 2%, optionally at greater than or equal to about 1 to less than or equal to about 1.5%, and in certain variations at about 1% by weight of the total pellet composition. A balance of the pellet composition comprises binder, pigments, and lubricants. The presence of the one or more inorganic additives in the pellet composition favorably improves a rate of aging at temperature near, but below the $T_f$, which is reflected by observing a normalized height of the pellet under certain temperatures conditions, therefore providing another technique by which thermal stability is improved.

As noted above, for such a thermally stable pellet composition comprising M-phenylenedibenzoate and with talc and fumed silica as the inorganic stability additives, it has been observed that thermal stability is improved by a rate of aging at $T_f$−15 being slowed by 5% to 7% (as set forth in Example 2 and Table 2 for 15 samples tested). A rate of aging at $T_f$−10 is likewise slowed by 2% to 5% (as set forth in Example 2 and Table 2 for 15 samples tested).

In yet another embodiment, the present disclosure provides a pellet composition for use in a thermally-actuated, current cutoff device that comprises an organic compound comprising p-acetotoluidide. The pellet composition of this embodiment further comprises one or more inorganic stability additive particles comprising siloxane powder. The pellet composition has a transition temperature ($T_f$) of greater than or equal to about 145° C. to less than or equal to about 157° C., optionally greater than or equal to about 150° C. to less than or equal to about 155° C., and in certain embodiments a $T_f$ of about 152° C.

In one variation, the p-acetotoluidide organic compound is present at greater than or equal to about 95 to less than or equal to about 99.9%, optionally at greater than or equal to about 98 to less than or equal to about 99.5%, and in certain variations at about 99% by weight of the total pellet composition. The siloxane powder is present at greater than or equal to about 0.1 to less than or equal to about 1%, optionally at greater than or equal to about 0.2 to less than or equal to about 2%, optionally at greater than or equal to about 0.3 to less than or equal to about 1.5%, optionally at greater than or equal to about 0.4 to less than or equal to about 1%, optionally at greater than or equal to about 0.5 to less than or equal to about 0.9%, and in certain variations at about 0.8% by weight of the total pellet composition. A balance of the pellet composition comprises lubricant.

As noted above, for such a thermally stable pellet composition comprising P-acetotoluidide and siloxane powder as the inorganic stability additive, it has been observed that thermal stability is improved by an overall increase in the breakdown voltage at 230° C. by about 9% (for 10 samples tested in Example 2 and as set forth in Table 2). Such a composition results in an improved maximum dielectric capability temperature ($T_{cap}$), which is believed to result in a potential increase in a $T_{max}$ above the present rating of 205° C. (for a comparative composition lacking the inventive additives), as well.

In yet another embodiment, the present disclosure provides a pellet composition for use in a thermally-actuated, current cutoff device that comprises an organic compound comprising 7-Hydroxy-4-methylcoumarin. The pellet composition of this embodiment further comprises one or more inorganic stability additive particles comprising siloxane powder. The pellet composition has a transition temperature ($T_f$) of greater than or equal to about 185° C. to less than or equal to about 195° C., optionally greater than or equal to about 190° C. to less than or equal to about 195° C., and in certain embodiments a $T_f$ of about 192° C.

In certain variations, a pellet composition of the present teachings comprises one or more organic compounds comprising 7-hydroxy-4-methylcoumarin and one or more inorganic stability additive particles comprising siloxane powder at present at less than about 3.0% by weight of the total composition. In one variation, the 7-Hydroxy-4-methylcoumarin organic compound is present at greater than or equal to about 95 to less than or equal to about 99.9%, optionally at greater than or equal to about 96 to less than or equal to about 99%. In one embodiment, the 7-Hydroxy-4-methylcoumarin organic compound is present at about 96.5% by weight of the total pellet composition. In another embodiment, the 7-Hydroxy-4-methylcoumarin organic compound is present at about 98.7% by weight of the total pellet composition. The siloxane powder is optionally present at greater than or equal to about 0.1 to less than or equal to about 3.5% or optionally at greater than or equal to about 0.5 to less than or equal to about 3.25%. In one embodiment, the siloxane powder is optionally present at about 0.8% by weight of the total pellet composition. In another embodiment, the siloxane powder is optionally present at about 3% by weight of the total pellet composition. A balance of the pellet composition comprises lubricant and pigment.

As noted above, for such a thermally stable pellet composition comprising 7-Hydroxy-4-methylcoumarin and siloxane powder as the inorganic stability additive, it has been observed that thermal stability is improved by an overall increase in the breakdown voltage at 240° C. by about 22% (for 10 samples having 0.8% siloxane powder and 98.7% of the 7-Hydroxy-4-methylcoumarin organic compound in Example 2 and as set forth in Table 2). Further, it has been observed that thermal stability is improved by an overall increase in the breakdown voltage at 240° C. by about 10% (for 10 samples having 3% siloxane powder and 96.5% of the 7-Hydroxy-4-methylcoumarin organic compound in Example 2 and as set forth in Table 2). Such a composition thus results in an improved maximum dielectric capability temperature ($T_{cap}$), which is believed to result in a potential increase in a $T_{max}$ above the present rating of 210° C. (for a comparative composition lacking the inventive additives), as well.

In one variation, the present disclosure provides a pellet composition for use in a thermally-actuated, current cutoff device that comprises an organic compound comprising dimethyl terephthalate. The pellet composition of this embodiment further comprises one or more inorganic stability additive particles comprising both fumed silica and talc. The pellet composition has a transition temperature ($T_f$) of greater than or equal to about 140° C. to less than or equal to about 148° C., optionally greater than or equal to about 142° C. to less than or equal to about 146° C., and in certain embodiments a $T_f$ of about 144° C.

In one variation, the dimethyl terephthalate organic compound is present at greater than or equal to about 92 to less than or equal to about 98%, optionally at greater than or equal to about 93 to less than or equal to about 97%, and in certain variations optionally at greater than or equal to about 94 to less than or equal to about 97% of the total pellet composition. In one embodiment, the dimethyl terephthalate organic compound is present at about 94.5% by weight of the total pellet composition. In another embodiment, the dimethyl terephthalate organic compound is present at about 96.4% by weight of the total pellet composition.

The fumed silica is present at greater than or equal to about 0.5 to less than or equal to about 3% and optionally at greater than or equal to about 0.75 to less than or equal to about 2.5% by weight of the total pellet composition. In one embodiment, the fumed silica is optionally present at about 1.9% by weight of the total pellet composition. In another embodiment, the fumed silica is optionally present at about 1% by weight of the total pellet composition. Likewise, the talc is present at greater than or equal to about 0.5 to less than or equal to about 3% and optionally at greater than or equal to about 0.75 to less than or equal to about 2.5% by weight of the total pellet composition. In one embodiment, the talc is optionally present at about 1.9% by weight of the total pellet composition. In another embodiment, the talc is optionally present at about 1% by weight of the total pellet composition. A balance of the pellet composition comprises pigments, and lubricants.

In such embodiments, the pellet composition consistently and repeatedly improves a $T_{max}$, where the pellet composition loses substantial dielectric properties and conducts current of at least greater than or equal to about 20° C. greater than the $T_f$. Improvement in pass rate is 75% to 90% in Example H, for example. It is noted that as discussed above, the actual maximum dielectric capability temperature ($T_{cap}$) for the pellet composition may be significantly higher than the rated maximum temperature ($T_{max}$). In such embodiments, the pellet composition consistently and repeatedly has a rated maximum breakdown temperature ($T_{max}$) of greater than or equal to about 235° C.; optionally greater than or equal to about 237° C.; and in certain variations optionally greater than or equal to about 240° C. The $T_{max}$ rating of the 144 chemical without additives is 240° C.

As noted above, for such a thermally stable pellet composition comprising dimethyl terephthalate with talc and fumed silica as the inorganic stability additives, it has been observed that thermal stability is improved by increasing a pass rate for $T_{max}$ at 500 v 380° C. from 75% to 90% (for 20 samples having 1.9% fumed silica, 1.9% talc and 94.5% of the dimethyl terephthalate as the organic compound in Example 2 and as set forth in Table 2). This suggests the potential to increase the $T_{max}$ rating above the present 240° C. Further, it has been observed that thermal stability is improved by a rate of aging at $T_f$−15 being slowed by 5% to 10% (for 20 samples having 1.9% fumed silica, 1.9% talc and 94.5% of the dimethyl terephthalate as the organic compound in Example 2 and as set forth in Table 2). In other embodiments, a thermal stability of the pellet composition is improved by a rate of aging at $T_f$−15 being slowed by 3.5% (for 20 samples having 1% fumed silica, 1% talc and 96.4% of the dimethyl terephthalate as the organic compound in Example 2 and as set forth in Table 2)

In other aspects, the present teachings provide methods for making a pellet composition having enhanced thermal stability for use in a thermally-actuated, current cutoff device. Such a method can comprise admixing one or more organic compounds and one or more inorganic stability additive particles selected from the group consisting of: silica, talc, siloxane, and combinations thereof to a pellet composition. Such admixing can include homogenous mixing of the organic compound(s) and inorganic stability additive(s) and any other additive components present. The mixture is then pelletized and compacted to form a solid thermal pellet that is capable of use in the thermally-actuated, current cutoff device. In certain variations, the mixture can be treated to crystallize the one or more organic compounds prior to or after compacting the mixture in a die to form the pellet material. The solid thermal pellet maintains its structural rigidity up to a transition temperature ($T_f$). The pellet composition also has a maximum dielectric capability temperature ($T_{cap}$) above which the pellet composition may lose substantial dielectric properties optionally at least about 20° C.; optionally at least about 30° C.; optionally at least about 40° C.; and in certain preferred variations, optionally at least about 50° C. greater than the $T_f$. In certain variations, $T_{cap}$ is greater than or equal to about 380° C. Such methods include forming any permutation of the embodiments of pellet compositions described previously above.

In yet other aspects, the present teachings provide methods for enhancing thermal stability of a pellet composition for use in a thermally-actuated, current cutoff device. In certain variations, such a method may comprise introducing one or more inorganic stability additive particles selected from the group consisting of: silica, talc, siloxane, and combinations thereof to a pellet composition. Prior to introducing the inorganic stability additive particles, the pellet composition maintains its structural rigidity up to a transition temperature ($T_f$). Additionally, prior to introducing the inorganic stability additive particles, the pellet composition has an initial maximum dielectric capability temperature ($T_{capinitial}$) above which the pellet composition may lose substantial dielectric properties, in a range of about 100° C. above the $T_f$. The $T_{capinitial}$ thus exceeds the Tf, but falls within 100° C. of the $T_f$, so that $T_f < T_{capinitial} \leq T_f + 100°$ C. After introducing the one or more inorganic stability additive particles to the pellet composition, the $T_f$ remains substantially the same, but the thermal pellet composition has an improved maximum dielectric capability temperature ($T_{capimproved}$) that is at least about 50° C., preferably at least about 70° C. greater than the $T_f$, as previously discussed above. Thus, after introducing the one or more inorganic stability additive particles to the pellet composition, $T_{capimproved} > T_f + 50°$ C., preferably $T_{capimproved} > T_f + 70°$ C., and optionally $T_{capimproved} > T_f + 100°$ C. In certain aspects, maximum dielectric capability temperature ($T_{cap}$) after introducing the one or more inorganic stability additives is greater than or equal to about 380° C. Although for brevity, the thermal stability and performance parameters described above are not repeated here, any of these parameters may be achieved by such methods.

In certain aspects, after the introducing of the one or more inorganic stability additive particles, the pellet composition consists essentially of the one or more organic compounds, the one or more inorganic stability additive particles, and one or more components selected from the group consisting of: binders, lubricants, press-aids, pigments, and combinations thereof. In certain variations, the one or more organic compounds are selected from the group of m-phenylenedibenzoate, dimethyl terephthalate, p-acetotoluidide, benzanilide, 2',6',acetoxylidide, dimethylacetanilide, 7-hydroxy-4-methylcoumarin, triptycene, 1, aminoanthroquinone, and combinations thereof. Any of the inventive pellet composition embodiments discussed above is contemplated as particularly useful in the present methods of improving thermal stability.

Therefore, the present disclosure provides in certain variations, a method for enhancing thermal stability of a pellet composition for use in a thermally-actuated, current cutoff device. The method comprises introducing one or more inorganic stability additive particles selected from the group consisting of: silica, talc, siloxane, and combinations thereof to an initial pellet composition. The initial pellet composition maintains its structural rigidity up to a transition temperature ($T_f$) and further has an initial maximum dielectric capability temperature ($T_{capinitial}$) above which the initial pellet composition may lose substantial dielectric properties and conducts current. In various aspects, the initial maximum dielectric capability temperature ($T_{capinitial}$) is greater than the transition temperature $T_f$. In certain variations, the initial maximum dielectric capability temperature ($T_{capinitial}$) falls within a range of 100° C. above $T_f$ (so that $T_f < T_{capinitial} \leq (T_f + 100°$ C.)). After introducing of the one or more inorganic stability additive particles to the initial pellet composition, an improved pellet composition is formed that exhibits the same $T_f$ as the initial pellet composition, but has an improved maximum dielectric capability temperature that, so that $T_{capimproved} \geq (T_f + 50°$ C.). In certain variations, the improved maximum dielectric capability temperature ($T_{capimproved}$) may be well in excess of 50° C. greater than the $T_f$, for example, at least about 100° C. or more above $T_f$.

In certain variations, after the introducing of the one or more inorganic stability additive particles, the pellet composition consists essentially of the one or more organic compounds, the one or more inorganic stability additive particles, and one or more components selected from the group consisting of: binders, lubricants, press-aids, pigments, and combinations thereof.

In other variations, the one or more organic compounds are selected from the group of m-phenylenedibenzoate, dimethyl terephthalate, p-acetotoluidide, benzanilide, 2',6',acetoxylidide, dimethylacetanilide, 7-hydroxy-4-methylcoumarin, coumarin, benzoguanimine, and combinations thereof. In certain variations, the one or more inorganic stability additive particles comprises fumed silica present within the improved pellet composition at greater than or equal to about 1% by weight to less than or equal to about 2% by weight of the total improved pellet composition. In certain variations, the transition temperature $T_f$ is greater than or equal to about 120° C. and the improved maximum dielectric capability temperature is about 125° C. or greater than the $T_f$. In yet other variations, the improved maximum dielectric capability temperature is about 200° C. or greater than the $T_f$. Further, in certain variations, the one or more inorganic stability additive particles comprises talc present within the improved pellet composition at greater than or equal to about 1% by weight to less than or equal to about 2% by weight of the total improved pellet composition. In select variations, the one or more inorganic stability additive particles may comprise fumed silica present within the improved pellet composition at greater than or equal to about 1% by weight to less than or equal to about 2% by weight of the total improved pellet composition and talc present within the improved pellet composition at greater than or equal to about 1% by weight to less than or equal to about 2% by weight of the total improved pellet composition. In yet other variations, the one or more inorganic stability additive particles comprises siloxane powder present within the improved pellet composition at greater than or equal to about 0.8% by weight to less than about 2.9% by weight of the total improved pellet composition.

In other aspects, the present disclosure provides another method for enhancing thermal stability of a pellet composition for use in a thermally-actuated, current cutoff device. The method comprises introducing one or more inorganic stability additive particles selected from the group consisting of: silica, talc, siloxane, and combinations thereof to an initial pellet composition that maintains its structural rigidity up to a transition temperature ($T_f$). After the introducing of the one or more inorganic stability additive particles to the initial pellet composition, an improved pellet composition is formed that exhibits the same $T_f$ as the initial pellet composition, but has a slower rate of aging at a temperature below the $T_f$ of at least 2%, as compared to the initial pellet composition.

The one or more organic compounds may be selected from the group of m-phenylenedibenzoate, dimethyl terephthalate, p-acetotoluidide, benzanilide, 2',6',acetoxylidide, dimethylacetanilide, 7-hydroxy-4-methylcoumarin, coumarin, benzoguanimine, and combinations thereof, in certain aspects. In certain select variations, the one or more organic compounds are selected from the group of m-phenylenedibenzoate, dimethyl terephthalate, and combinations thereof. In certain aspects, the one or more inorganic stability additive particles is selected from fumed silica, talc, or combinations of silica and talc. In further select variations, the one or more inorganic stability additive particles comprises fumed silica present within the improved pellet composition at greater than or equal to about 1% by weight to less than or equal to about 2% by weight of the total improved pellet composition and talc present within the improved pellet composition at greater than or equal to about 1% by weight to less than or equal to about 2% by weight of the total improved pellet composition.

In this manner, the present teachings provide pellet material compositions with performance-enhancing additives and methods of making and improving such compositions, wherein higher maximum dielectric capability temperature ($T_{cap}$), higher maximum breakdown temperatures ($T_{max}$) ratings, and/or better high temperature stability reflected by reduced rates of aging and pellet height reductions are provided by the addition of certain inorganic stability promoting additives. The TCOs are thus highly stable, robust, and are capable of use as switching devices that further bolster the safety measures that previous TCO applications already accomplished.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A pellet composition for use in a thermally-actuated, current cutoff device, the pellet composition comprising:

one or more organic compounds present at greater than or equal to about 93% by weight of a total pellet composition; and one or more inorganic stability additive particles selected from the group consisting of: silica, talc, siloxane, and combinations thereof, present at less than or equal to about 5% by weight of the total pellet composition, wherein the pellet composition is in a solid phase and maintains its structural rigidity up to a transition temperature ($T_f$) and the pellet composition maintains dielectric properties and blocks conduction of current up to a maximum dielectric capability temperature ($T_{cap}$) above which the pellet composition loses substantial dielectric properties and conducts current that is about 50° C. or greater than the $T_f$.

2. The pellet composition of claim 1, wherein the one or more organic compounds are selected from the group of m-phenylenedibenzoate, dimethyl terephthalate, p-acetotoluidide, benzanilide, 2',6',acetoxylidide, di methylacetanilide, 7-hydroxy-4-methylcoumarin, coumarin, benzoguanimine, and combinations thereof.

3. The pellet composition of claim 1, wherein the transition temperature ($T_f$) is greater than or equal to about 120° C. and the maximum dielectric capability temperature ($T_{cap}$) is about 125° C. or greater than the $T_f$.

4. The pellet composition of claim 1, wherein the maximum dielectric capability temperature ($T_{cap}$) is about 200° C. or greater than the transition temperature ($T_f$).

5. The pellet composition of claim 1, wherein the one or more inorganic stability additive particles comprises fumed silica at greater than or equal to about 1% by weight to less than or equal to about 2% by weight of the total pellet composition.

6. The pellet composition of claim 1, wherein the one or more inorganic stability additive particles comprises talc at greater than or equal to about 1% by weight to less than or equal to about 2% by weight of the total pellet composition.

7. The pellet composition of claim 1, wherein the one or more inorganic stability additive particles comprises fumed silica at greater than or equal to about 1% by weight to less than or equal to about 2% by weight of the total pellet composition and talc at greater than or equal to about 1% by weight to less than or equal to about 2% by weight of the total pellet composition.

8. The pellet composition of claim 1, wherein the one or more inorganic stability additive particles comprises siloxane powder at greater than or equal to about 0.8% by weight to less than about 2.9% by weight of the total pellet composition.

9. The pellet composition of claim 1 consisting essentially of the one or more organic compounds, the one or more inorganic stability additive particles, and one or more components selected from the group consisting of: binders, lubricants, press-aids, pigments, and combinations thereof.

10. The pellet composition of claim 9, wherein the one or more components are cumulatively present at less than or equal to about 10% by weight of the total pellet composition and the one or more inorganic stability additive particles are cumulatively present at less than about 5% by weight of the total pellet composition.

11. The pellet composition of claim 9, wherein the one or more organic compounds is a single organic compound.

12. A pellet composition for use in a thermally-actuated, current cutoff device, the pellet composition comprising:

one or more organic compounds are selected from the group of consisting of: m-phenylenedibenzoate, dimethyl terephthalate, p-acetotoluidide, benzanilide, 2',6', acetoxylidide, di methylacetanilide, 7-hydroxy-4-methylcoumarin, coumarin, benzoguanimine, and combinations thereof; and one or more inorganic stability additive particles present at less than about 3% by weight of the total pellet composition, wherein the one or more inorganic stability additive particles are selected from the group consisting of: silica, talc, siloxane, and combinations thereof, wherein the pellet composition is in a solid phase and maintains its structural rigidity up to a transition temperature ($T_f$) and further the pellet composition maintains dielectric properties and blocks conduction of current up to a maximum dielectric capability temperature ($T_{cap}$) above which the pellet composition loses substantial dielectric properties and conducts current that is about 50° C. or greater than the $T_f$.

13. The pellet composition of claim 12, wherein the maximum dielectric capability temperature ($T_{cap}$) is greater than or equal to about 380° C. and less than or equal to about 410° C.

14. The pellet composition of claim 12, wherein the one or more inorganic stability additive particles comprises silica at greater than or equal to about 1% by weight to less than or equal to about 2% by weight of the total pellet composition and talc at greater than or equal to about 1% by weight to less than or equal to about 2% by weight of the total pellet composition.

15. The pellet composition of claim 12, wherein the one or more inorganic stability additive particles comprise siloxane at greater than or equal to about 0.8% by weight to less than about 2.9% by weight of the total pellet composition.

16. The pellet composition of claim 12 consisting essentially of the one or more organic compounds, the one or more inorganic stability additive particles, and one or more components selected from the group consisting of: binders, lubricants, press-aids, pigments, and combinations thereof.

17. A method for enhancing thermal stability of a pellet composition for use in a thermally-actuated, current cutoff device, the method comprising:

providing an initial pellet composition that maintains its structural rigidity up to a transition temperature ($T_f$) and has an initial maximum dielectric capability temperature ($T_{capinitial}$) below which the initial pellet composition maintains dielectric properties and blocks conduction of current and above which the initial pellet composition may lose substantial dielectric properties and conducts current that is about 100° C. or less above $T_f$ so that $T_f < T_{capinitial} \leq (T_f + 100°\ C.)$; and introducing one or more inorganic stability additive particles selected from the group consisting of: silica, talc, siloxane, and combinations thereof to the initial pellet composition to create an improved pellet composition and forming a pellet comprising the improved pellet composition that exhibits the same $T_f$ as the initial pellet composition, but has an improved maximum dielectric capability temperature ($T_{capimproved}$) that is about 50° C. or greater than the $T_f$, so that $T_{capimproved} \geq (T_f + 50°\ C.)$.

18. The method of claim 17, wherein after the introducing of the one or more inorganic stability additive particles, the pellet composition consists essentially of one or more organic compounds, the one or more inorganic stability additive particles, and one or more components selected from the group consisting of: binders, lubricants, press-aids, pigments, and combinations thereof.

19. The method of claim 18, wherein the one or more organic compounds are selected from the group of m-phenylenedibenzoate, dimethyl terephthalate, p-acetotoluidide, benzanilide, 2',6',acetoxylidide, di methylacetanilide, 7-hydroxy-4-methylcoumarin, coumarin, benzoguanimine, and combinations thereof.

20. The method of claim 17, wherein the transition temperature ($T_f$) is greater than or equal to about 120° C. and the improved maximum dielectric capability temperature ($T_{capimproved}$) is about 125° C. or greater than the $T_f$.

21. The method of claim 17, wherein the improved maximum dielectric capability temperature ($T_{capimproved}$) is about 200° C. or greater than the transition temperature ($T_f$).

22. The method of claim 17, wherein the one or more inorganic stability additive particles comprises fumed silica present within the improved pellet composition at greater than or equal to about 1% by weight to less than or equal to about 2% by weight of the total improved pellet composition.

23. The method of claim 17, wherein the one or more inorganic stability additive particles comprises talc present within the improved pellet composition at greater than or equal to about 1% by weight to less than or equal to about 2% by weight of the total improved pellet composition.

24. The method of claim 17, wherein the one or more inorganic stability additive particles comprises fumed silica present within the improved pellet composition at greater than or equal to about 1% by weight to less than or equal to about 2% by weight of the total improved pellet composition and talc present within the improved pellet composition at greater than or equal to about 1% by weight to less than or equal to about 2% by weight of the total improved pellet composition.

25. The method of claim 17, wherein the one or more inorganic stability additive particles comprises siloxane powder present within the improved pellet composition at greater than or equal to about 0.8% by weight to less than about 2.9% by weight of the total improved pellet composition.

26. A method for enhancing thermal stability of a pellet composition for use in a thermally-actuated, current cutoff device, the method comprising:

providing an initial pellet composition that blocks conduction of current and maintains its structural rigidity up to a transition temperature ($T_f$); and introducing one or more inorganic stability additive particles selected from the group consisting of: silica, talc, siloxane, and combinations thereof to the initial pellet composition to create an improved pellet composition and forming a pellet comprising the improved pellet composition that exhibits the same $T_f$ as the initial pellet composition, but has a slower rate of aging at a temperature below the $T_f$ of at least 2%, as compared to the initial pellet composition.

27. The method of claim 26, wherein the one or more organic compounds are selected from the group of m-phenylenedibenzoate, dimethyl terephthalate, and combinations thereof.

28. The method of claim 26, wherein the one or more inorganic stability additive particles comprises fumed silica, talc, or combinations of silica and talc.

29. The method of claim 26, wherein the one or more inorganic stability additive particles comprises fumed silica present within the improved pellet composition at greater than or equal to about 1% by weight to less than or equal to about 2% by weight of the total improved pellet composition and talc present within the improved pellet composition at greater than or equal to about 1% by weight to less than or equal to about 2% by weight of the total improved pellet composition.

* * * * *

UNITED STATES PATENT AND TRADEMARK OFFICE

CERTIFICATE OF CORRECTION

PATENT NO. : 9,171,654 B2
APPLICATION NO. : 13/918548
DATED : October 27, 2015
INVENTOR(S) : Katherine Hinrichs and Changcai Zhao It is certified that error appears in the above-identified patent and that said Letters Patent is hereby corrected as shown below:

ON THE TITLE PAGE

In col. 1, (65) Prior Publication Data, after "Dec. 19, 2013", insert --¶(30) Foreign Application Priority Data Jun. 15, 2012 (CN) 201210201999.7--.

IN THE SPECIFICATION

In col. 10, Detailed Description, line 11, delete "Tf," and insert --$T_f$,--.

In col. 14, Detailed Description, line 37, delete "calorimetry" and insert --Calorimetry--.

In col. 25-26, Detailed Description, Table 2, Line 2, delete "($T_F$)" and insert --($T_f$)--.

In col. 33, Detailed Description, Line 31, delete "homogenous" and insert --homogeneous--.

IN THE CLAIMS

In col. 36, Claim 2, Line 33-34, delete "di methylacetanilide," and insert --dimethylacetanilide,--.

In col. 37, Claim 12, Line 14, delete "di methylacetanilide," and insert --dimethylacetanilide,--.

In col. 38, Claim 19, Line 15, delete "di methylacetanilide," and insert --dimethylacetanilide,--.

Signed and Sealed this
Fifth Day of April, 2016

Michelle K. Lee

Michelle K. Lee
*Director of the United States Patent and Trademark Office*